US010053876B2

(12) United States Patent
Jensen

(10) Patent No.: US 10,053,876 B2
(45) Date of Patent: Aug. 21, 2018

(54) MOLD FOR MODULAR UNITS FOR INSULATING CONCRETE FORMS

(71) Applicant: THERMAGREEN SYSTEMS, INC., Orem, UT (US)

(72) Inventor: Daniel Max Jensen, South Jordan, UT (US)

(73) Assignee: THERMAGREEN SYSTEMS, INC., Orem, UT (US)

( * ) Notice: Subject to any disclaimer, the term of this patent is extended or adjusted under 35 U.S.C. 154(b) by 0 days.

(21) Appl. No.: 15/487,790

(22) Filed: Apr. 14, 2017

(65) Prior Publication Data

US 2017/0218642 A1 Aug. 3, 2017

Related U.S. Application Data

(63) Continuation of application No. 14/614,282, filed on Feb. 4, 2015, now Pat. No. 9,650,784.

(Continued)

(51) Int. Cl.
*E04G 13/02* (2006.01)
*E04B 2/18* (2006.01)

(Continued)

(52) U.S. Cl.
CPC ..... *E04G 13/021* (2013.01); *E04B 2/18* (2013.01); *E04B 2/24* (2013.01); *E04C 1/39* (2013.01);

(Continued)

(58) Field of Classification Search
CPC ... B28B 11/042; B28B 11/043; B29C 44/324; E04B 2/42; E04B 2/52; E04B 2/26;

(Continued)

(56) References Cited

U.S. PATENT DOCUMENTS 2,684,589 A 7/1954 Perreton
3,552,076 A 1/1971 Gregori (Continued)

FOREIGN PATENT DOCUMENTS

DE 3407867 A1 9/1985
NL 06000030 A 6/2006
RU 002459913 C2 8/2012

OTHER PUBLICATIONS

Building Envelope Solutions, Inc, Aug. 2008 http://web.archive.org/web/20080828190625/http://foam- tech.com/case_studies/historic_intro.htm.

(Continued)

*Primary Examiner* — Babajide A Demuren
(74) *Attorney, Agent, or Firm* — Stoel Rives, LLP; R. Whitney Johnson

(57) ABSTRACT

Embodiments of modular building units (blocks) are disclosed that can be stacked to provide insulating concrete forms (ICFs). The blocks are formed of a foamed polymer material, such as foamed polyurethane. The blocks, when assembled together in an ICF, are configured to form one or more vertical columns of concrete and one or more horizontal beams of concrete intersecting the one or more columns, in a manner of post and beam construction. The blocks can be tightly interlocked with other blocks in a construction process. The disclosed blocks can include significant interior space for rebar and concrete to be inserted to construct the structure. Molds and methods for producing modular units are also disclosed. The molds and methods enable rapid production and removal of modular building units from the molds. Methods of constructing structures using the modular building units are also disclosed.

20 Claims, 20 Drawing Sheets

Related U.S. Application Data

(60) Provisional application No. 61/935,490, filed on Feb. 4, 2014.

(51) Int. Cl.

| | |
|---|---|
| ***E04B 2/24*** | (2006.01) |
| ***E04C 1/39*** | (2006.01) |
| ***E04G 13/04*** | (2006.01) |
| *E04B 2/02* | (2006.01) |
| *E04B 1/20* | (2006.01) |

(52) U.S. Cl.
CPC ..... *E04G 13/04* (2013.01); *E04B 1/20* (2013.01); *E04B 2002/0215* (2013.01); *E04B 2103/02* (2013.01); *E04B 2103/04* (2013.01)

(58) Field of Classification Search
CPC ..... E04B 2/41; E04B 2002/023; E04B 2002/0206; E04B 2103/04; E04B 2103/02; E04B 2002/0232; E04C 1/41
See application file for complete search history.

(56) References Cited

U.S. PATENT DOCUMENTS

| | | | | |
|---|---|---|---|---|
| 3,782,049 | A | 1/1974 | Sachs | |
| 3,788,020 | A | 1/1974 | Gregori | |
| 3,800,015 | A * | 3/1974 | Sachs | B29C 44/324 249/125 |
| 4,038,798 | A | 8/1977 | Sachs | |
| 4,075,808 | A | 2/1978 | Pearlman | |
| 4,275,539 | A * | 6/1981 | Abbott, III | B28B 11/042 264/45.4 |
| 4,475,326 | A | 10/1984 | Hanson | |
| 4,802,318 | A | 2/1989 | Snitovski | |
| 4,967,528 | A | 11/1990 | Doran | |
| 5,086,600 | A | 2/1992 | Holland et al. | |
| 5,123,222 | A | 6/1992 | Guarriello et al. | |
| 5,459,971 | A | 10/1995 | Sparkman | |
| 5,465,542 | A | 11/1995 | Terry | |
| 5,729,943 | A | 3/1998 | Cambiuzzi | |
| 5,839,243 | A | 11/1998 | Martin | |
| 5,921,046 | A * | 7/1999 | Hammond, Jr. | E04B 1/12 52/220.2 |
| 6,018,922 | A | 2/2000 | McKinnon | |
| 6,253,519 | B1 | 7/2001 | Daniel | |
| 6,676,862 | B2 | 1/2004 | Jensen | |
| 7,765,765 | B1 | 8/2010 | Perronne | |
| 7,942,658 | B1 | 5/2011 | Jensen | |
| 8,074,419 | B1 | 12/2011 | Humphress et al. | |
| 9,650,784 | B2 | 5/2017 | Jensen | |
| 2002/0148187 | A1 | 10/2002 | Walters | |
| 2004/0159068 | A1 | 8/2004 | Prokofyev | |
| 2005/0275124 | A1 | 12/2005 | Franklin | |
| 2005/0276156 | A1 | 12/2005 | Elsten | |
| 2006/0010827 | A1 | 1/2006 | Vanhoutte | |
| 2006/0201090 | A1 | 9/2006 | Guevara | |
| 2008/0066408 | A1 | 3/2008 | Hileman et al. | |
| 2010/0319285 | A1 | 12/2010 | Jewett | |
| 2011/0138702 | A1 | 6/2011 | Kelley | |

OTHER PUBLICATIONS

International Search Report and Written Opinion for PCT/US2015/014499 dated May 11, 2015.
Office Action dated Jul. 2, 2015, in U.S. Appl. No. 14/614,282, filed Feb. 4, 2015.
Final Office Action dated Jan. 6, 2016, in U.S. Appl. No. 14/614,282, filed Feb. 4, 2015.
Office Action dated Jul. 26, 2016, in U.S. Appl. No. 14/614,282, filed Feb. 4, 2015.
Notice of Allowance dated Jan. 13, 2017, in U.S. Appl. No. 14/614,282, filed Feb. 4, 2015.

* cited by examiner

FIG. 2A
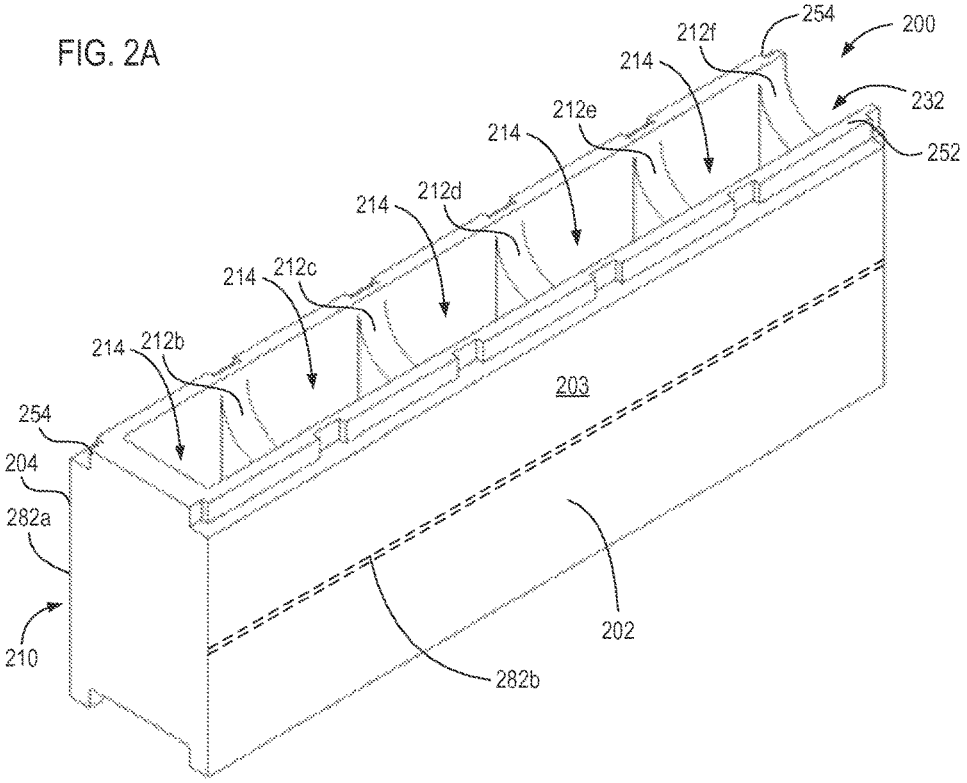
FIG. 2B
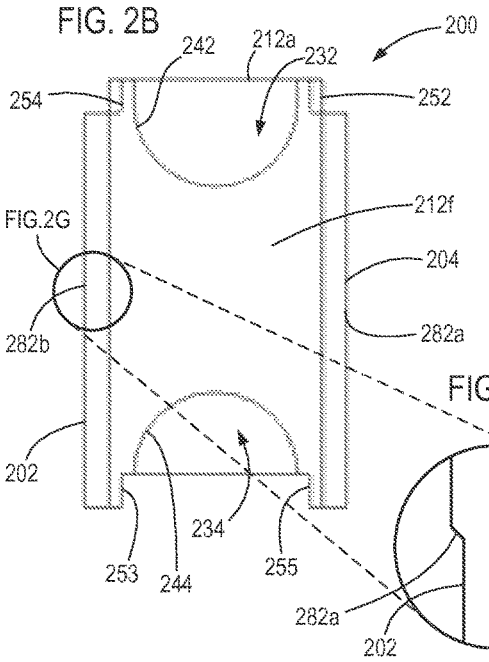
FIG. 2C
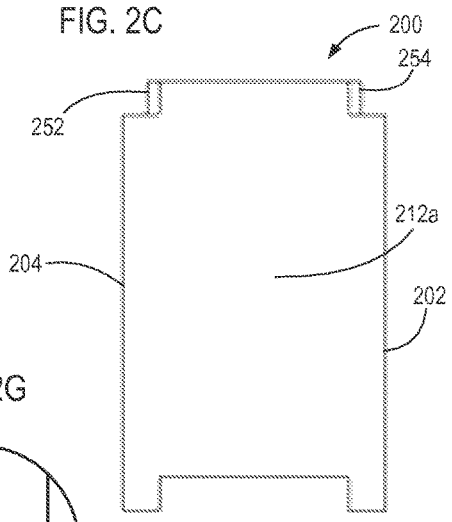
FIG.2G

MOLD FOR MODULAR UNITS FOR INSULATING CONCRETE FORMS

RELATED APPLICATIONS

This application is a continuation of U.S. patent application Ser. No. 14/614,282, titled "MODULAR UNITS FOR INSULATING CONCRETE FORMS," filed Feb. 4, 2015, which claims priority to U.S. Provisional Patent Application No. 61/935,490, titled "Polyurethane Building Block and Insulating Concrete Form Including Method of Manufacture and Stacking Wall System," filed Feb. 4, 2014, each of which is hereby incorporated by reference herein in its entirety.

TECHNICAL FIELD

The present disclosure relates generally to construction materials for constructing structures, and more particularly to modular units for erecting insulating concrete forms to construct concrete structures.

BACKGROUND

Post and beam (interlinked vertical and horizontal supports) construction has been used for centuries in building construction and is known for its strength and longevity. Post and beam construction is one of the ancient methods of building, and was used in Rome thousands of years ago. Post and beam construction is still used today. Timbers can be employed to erect post and beam support structures. Concrete forms can also be employed to erect concrete post and beam support structures.

Nearly half a century ago, petroleum derivative foam began to be used for insulation purposes in residential and commercial buildings. Often this foam was only sprayed inside the walls or under the roof for an additional measure of protection. As the use of this foam increased, insulating concrete forms (hereinafter referred to as "ICFs") were introduced. Today there are numerous varieties of methods, designs and types of petroleum-derived ICFs that have evolved for building purposes. Unlike wood or steel forms, the ICFs becomes a permanent part of the building, providing insulation that contributes to energy efficiency, decreased noise, and a smaller environmental footprint overall.

Generally, presently available ICFs include interlockable modular units, such as foam blocks, made of polystyrene beads that are poured into a mold and are fused together by the use of steam. These foam blocks generally are largely hollow with cavities that allow for columns of concrete to be poured inside them. The blocks are stacked to create a wall, and concrete is then poured into the interior openings of the blocks. Other presently available foam blocks interlock with other blocks to form a single large cavity that is filled by concrete. While many of these foam block ICF systems have met with some level of success, there are also a number of shortcomings. Challenges arise in creating the foam blocks, effectively fitting them together to form a secure wall, pouring concrete into the blocks, and applying finishing materials. Many of these issues arise because of the unique properties of polystyrene (widely used in most ICFs), which responds and acts differently than more familiar building materials. In view of these and other issues, the present inventor has recognized that improvements to insulating concrete forms is desirable.

SUMMARY

The present disclosure is directed to modular building units (also referred to herein as "blocks") that can be stacked to provide insulating concrete forms (ICFs) that attempt to address the above described and additional shortcomings of presently available polystyrene blocks and/or ICFs. The present disclosure also pertains to creation, production, and use in construction of blocks that can be easily and quickly created with molds, removed from the molds, and rapidly and tightly interlocked with other blocks in the construction process to form an immovable wall. The disclosed modular building units can include significant interior space for rebar and concrete to be inserted in order to form a core of a wall structure in the manner of, or similar to, post and beam construction with interlinked vertical and horizontal supports.

Additional aspects and advantages will be apparent from the following detailed description of preferred embodiments, which proceeds with reference to the accompanying drawings.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which:

FIG. 2A is a perspective view of a modular building unit, according to another embodiment of the present disclosure.

FIG. 2B is a right elevation view of the modular building unit of FIG. 2A.

FIG. 2C is a left elevation view of the modular building unit of FIG. 2A.

FIG. 2G is an enlargement of a portion of the left elevation view of FIG. 2C showing an enlargement of a portion of the modular building unit of FIG. 2A.

DETAILED DESCRIPTION OF PREFERRED EMBODIMENTS

Figure 1A:
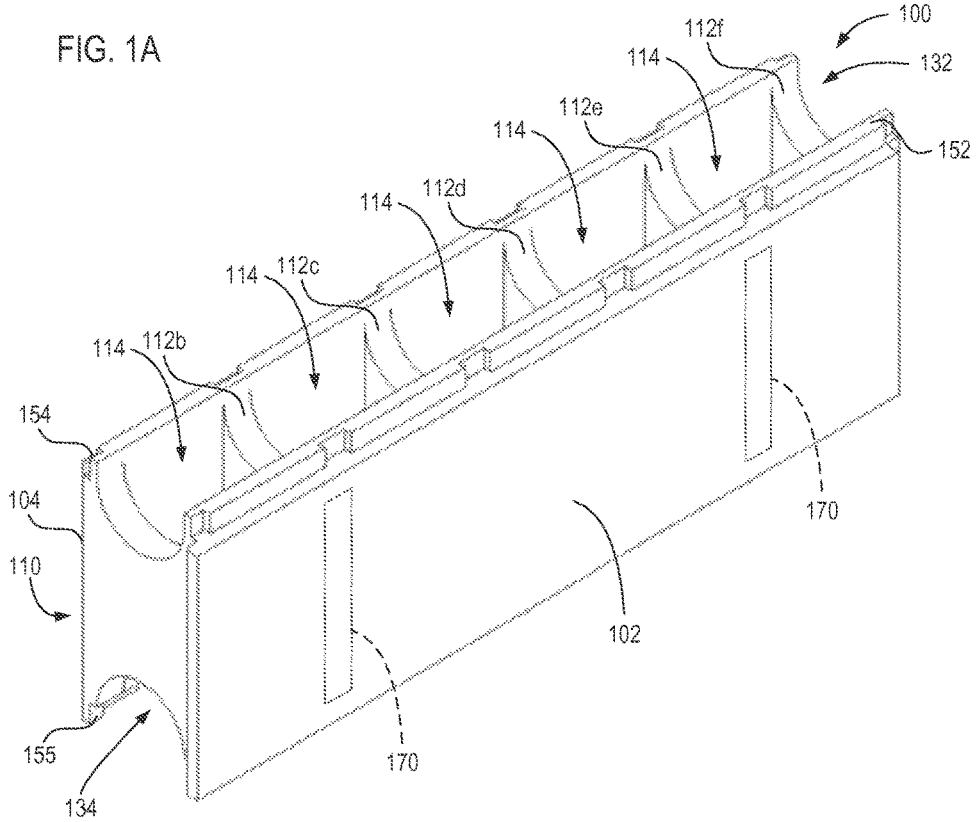
FIG. 1A is a perspective view of a modular building unit, according to one embodiment of the present disclosure.

Commercial construction and, in many instances, at least some portions of residential construction, typically involves constructing concrete support structures. Erecting a concrete support structure generally requires concrete forms into which the concrete is poured to form the desired concrete support structure.

Recently, insulating concrete forms (hereinafter referred to as "ICFs") have been developed in which interlocking foam blocks are used to erect a desired concrete form. These foam blocks are largely hollow with cavities that allow for columns of concrete to be poured inside them. The blocks of an ICF are stacked to create, for example, a wall, and concrete is then poured into the interior openings of the blocks. The ICFs become a permanent part of the building, providing insulation that contributes to energy efficiency, decreased noise, and a smaller environmental footprint overall.

The presently available blocks used in ICF systems are typically formed of petroleum-derived materials. For example, a commonly used material is polystyrene. The blocks are formed by pouring beads of polystyrene into a mold and fusing the beads together by the use of steam. Although presently available ICFs erected using polystyrene blocks have achieved some market success, many issues arise when using presently available ICFs because of the properties of polystyrene, which responds and acts differently than more familiar building materials. Polystyrene blocks may lack a measure of structural integrity, which may limit the dimensions of blocks that can be formed, which may in turn limit the dimensions of a concrete support structure that may be formed. The polystyrene foam of existing ICFs may need to be covered on the interior prior to occupancy in order to satisfy the fire code. The exterior polystyrene of ICFs generally requires a covering to protect the expanded bead polystyrene foam from outdoor elements. Extensive bracing is required with presently available ICFs, which can add to labor cost.

In addition to structural issues arising based on the materials of presently available blocks used in ICF systems, the blocks of presently available ICFs lack capability to form both vertical columns and discrete horizontal bond beams that connect to the vertical columns. The presently available ICFs form solid concrete cores that may crumble, for example, in an earthquake.

The present disclosure provides embodiments of modular units that are configured to be stacked and interlocked to provide concrete forms, which provide a structure and/or apparatus for constructing concrete walls and other structures. The present disclosure also pertains to a method and apparatus for making lightweight blocks that are capable of being easily stacked to provide the structure for creation of a post and beam building structure, when concrete is added inside the block. The present disclosure also pertains to methods of constructing concrete structures using insulating concrete forms erected from polyurethane modular units.

Modular Building Units

The present disclosure provides embodiments of foam modular building units, or blocks, for use in erecting ICFs. The disclosed foam blocks may be formed of foamed polyurethane, which is a material that is presently not used in manufacture of blocks of ICFs. The polyurethane embodiments of the blocks, according to the present disclosure, are both lightweight and durable, according to the properties of polyurethane. The polyurethane blocks can be configured to be interlocking and stackable to erect an ICF for pouring a concrete structure. The blocks each define cavities that, when interlocked with other modular building units, form vertical posts (or columns) and/or horizontal beams. The disclosed blocks can be formed to include a slight taper on outer side walls and/or inner side walls, at a point where one or more support members begin to clear the mold upon removal of the block from the mold. This taper makes it possible to remove the block from the mold with ease and without damaging the block. This slight taper in the mold which is reflected in each block allows for rapid manufacturing of blocks, and decreases the possibility that a block will be damaged during the manufacturing process.

A modular building unit, or block, for erecting insulated concrete forms for constructing structures, according to one embodiment, may include a front panel, a back panel, and a web of support structures connecting the front panel and the back panel. The block can be formed of a foamed polymer material, such as polyurethane, in a single injection molding process. The front panel includes an inner surface to provide a form for concrete when poured into the modular building unit. The back panel also includes an inner surface to provide a form for concrete when poured into the modular building unit. The web includes a plurality of support members formed of the foamed polymer material. The plurality of support members extend between and couple the front panel to the back panel. The plurality of support members are spaced from each other to at least partially define one or more vertical column cavities between the front panel and the back panel and extending within the modular building unit from a top opening at a top of the modular building unit to a bottom opening at a bottom of the modular building unit. The plurality of support members at least partially defining a horizontal beam cavity that is between the front panel and the back panel and that extend along a length of the modular building unit to intersect with the one or more vertical column cavities.

A first modular building unit is configured to stack on top of a second modular building unit such that a vertical column cavity of the first modular building unit aligns with a vertical column cavity of the second modular building unit to form a column of concrete, when concrete is poured into the first and second modular building units. The column of concrete would extend from a bottom opening of the vertical column cavity of the second modular building unit to the top opening of the vertical column cavity of the first modular building unit.

The horizontal beam cavity at least partially forms a beam of concrete, when concrete is poured into the modular building unit. The horizontal beam cavity extends along a length of the modular building unit and intersects with the vertical column. In other words, a formed beam of concrete is formed integral to the formed column of concrete. In addition, the modular building unit may interlock with an adjacent modular building unit such that the horizontal beam cavity of the modular building unit aligns with the horizontal beam cavity of the adjacent modular building unit. In other words, the two modular building units at least partially define an extended horizontal beam cavity that extends at least a partial length of both modular building units and intersects a plurality of vertical column cavities (e.g., a vertical column cavity of the modular building unit and a vertical column cavity of the adjacent modular building unit). The extended horizontal beam cavity can form a beam of concrete that extends at least a partial length of both the modular building unit and the adjacent modular building unit and intersects a plurality of columns of concrete.

Mold for Injection Molding of Modular Building Units

The present disclosure is also directed to embodiments of molds for molding a foamed polymer material into a modular building unit to be used for erecting insulated concrete forms for constructing a concrete structure. A mold, according to one embodiment, includes a molding box, a plurality of column cores, and a plurality of beam cores.

The mold box may include a front side plate, a back side plate, a first end plate, a second end plate, a base, and a lid. The front side plate provides a front side of the mold box and is configured to form an outer surface of a front panel of the modular building unit. The back side plate provides a back side of the mold box and is configured to form an outer surface of a back panel of the modular building unit. The first end plate provides a first end side of the mold box and is coupled to a first end of the front side plate and a first end of the back side plate. The first end plate is configured to form a first end surface of the front panel and the back panel of the modular building unit. The first end plate may be configured to form an outer surface of a first end support member that couples the front panel and the back panel. The second end plate provides a second end side of the mold box and is coupled to a second end of the front side plate and a second end of the back side plate. The second end plate is configured to form a second end surface of the front panel and the back panel of the modular building unit. The second end plate may be configured to form an outer surface of a second end support member that couples the front panel and the back panel. The lid provides a top of the mold box and is configured to form a top surface of the front panel and the back panel of the modular building unit. The base provides a bottom of the mold box and is configured to form a bottom surface of the front panel and the back panel of the modular building unit.

The plurality of column cores are configured to be positioned within the mold box to at least partially form a plurality of support members coupling the front panel and the back panel of the modular building unit. The front panel, the back panel, and the plurality of support members form a plurality of vertical column cavities of the modular building unit. Each column core of the plurality of column cores may at least partially form an inner surface of the front panel of the modular building unit and an inner surface of the back panel of the modular building unit. Each column core may further form vertical surfaces of one or more support structures that connect the front panel and the back panel of the modular building unit. In other words, each core may be configured to form one or more of an inner surface of the first end support member, an inner surface of the second end support member, and a vertical surface of an inner support member. In one embodiment, each core may be configured to form two of: an inner surface of the first end support member, an inner surface of the second end support member, and a vertical surface of an inner support member.

The plurality of beam cores may couple to one of the lid and the base to be positioned within the mold box to at least partially form a horizontal beam cavity of the modular building unit. Each beam core of the plurality of beam cores forms one of a top surface and a bottom surface of a support member. Each beam core of the first plurality of beam cores is configured to engage a column core to form the horizontal beam cavity to intersect a vertical column cavity of the plurality of vertical column cavities. In certain embodiments, each beam core of the plurality of beam cores may be configured to form a semicircle-shaped gap (or offset from a top of the front panel and back panel) in the one of the top surface and the bottom surface of a support member. The semicircle-shaped gaps in the plurality of support structures at least partially form in the modular building unit the horizontal beam cavity to intersect the one or more vertical column cavities formed in the modular building unit by the plurality of column cores.

The mold may further include a second plurality of beam cores coupled to the other one of the lid and the base. Like the first plurality of beam cores, the second plurality of beam cores is configured to be positioned within the mold box to at least partially define a second horizontal beam cavity of the modular building unit. Each beam core of the second plurality of beam cores forms the other one of the top surface and the bottom surface of a support member. Each beam core of the second plurality of beam cores is configured to engage a column core to form the second horizontal beam cavity to intersect a vertical column cavity of the plurality of vertical column cavities. In certain embodiments, each beam core of the second plurality of beam cores may be configured to form a semicircle-shaped gap (or offset from a top of the front panel and back panel) in the other one of the top surface and the bottom surface of a support member. The semicircle-shaped gaps in the plurality of support structures at least partially form in the modular building unit the second horizontal beam cavity to intersect one or more vertical cavities formed in the modular building unit.

The mold may include one or more tapers to facilitate release of a molded modular building unit from the mold. For example, the mold box may include a taper disposed in the inner surfaces of one or more of the front side plate, the back side plate, the first end plate, and the second end plate. As another example, the plurality of column cores may include a taper. The one or more tapers may be configured to form a narrowing of a bottom portion of the front panel and/or the back panel of a modular building unit, such that a thickness of the bottom portion of the front panel and/or the back panel is less than a thickness of a top portion. The narrowing allows a formed modular building unit to more easily release from the mold as the narrower bottom portion of the front panel and/or the back panel is raised to a wider top portion of the mold.

The mold may further include a compressed air system configured to inject air into the mold box beneath a formed and/or at least partially cured modular building unit to raise the modular building unit at least partially out of the mold. The mold box may be airtight, such that air may only escape through a top opening of the mold box when the lid is removed. The foaming polymer injected into the mold expands to fill every space in the mold. The expansion of the foamed polymer may create considerable surface tension that makes removal of the formed modular unit from the mold very difficult. In fact, presently available methods of forming modular units lack ability to effectively remove from a mold a modular unit formed by injecting a foaming polymer into the mold. Injection of air beneath the formed modular unit within the mold box creates chamber of air that gradually expands to push the block and raise it at least partially out of the mold.

Production of Modular Building Units in Molds

The present disclosure is also directed to methods of manufacturing a modular building unit for erecting insulated concrete forms for constructing structures. A modular building unit, or block, according to the present disclosure, may be created by injection of a foaming polymer material into a mold. In one embodiment of a method of manufacturing a modular building unit, a mold according to the present disclosure may be provided or obtained. The mold may be configured to mold a foamed polymer material into a modular building unit such that the modular building unit is configured to stack with other modular building units and to provide a form for concrete when poured into the modular building unit. The mold is configured to mold the modular building unit to define a vertical column cavity and to at least partially define a horizontal beam cavity intersecting the vertical column cavity.

An anti-bonding agent may be applied to the mold. The anti-bonding agent may be one or more sheets of a fluoropolymer, such as polytetrafluoroethylene. In other embodiments, the anti-bonding agent may be a silicone-based liquid. The anti-bonding agent may be sprayed onto the mold.

Two or more compounds are mixed that react to produce a foaming mixture that expands within the mold to fill one or more empty spaces within the mold. The foaming mixture cures or hardens as the reaction of the two compounds progresses to substantial completion. The foaming mixture, as it hardens or cures, becomes the foamed polymer material. For example, a polyol and an isocyanate may be mixed to react and produce a foaming mixture that cures into foamed polyurethane.

During the foaming reaction of the two or more compounds the mold can be secured in a closed position to contain expansion of the foaming mixture within the mold. For example, a lid of the mold may be closed (e.g., on hinges) and clamped to seal a mold box of the mold in an airtight configuration, following deposition of the two or more compounds. In other embodiments, the mold may be secured in a closed position prior to deposition of the two or more compounds.

After the reaction of the two compounds has progressed to substantial completion and the foaming mixture has substantially hardened or otherwise cured to the foamed polymer material, the modular building unit can be removed from the mold. For example, upon appropriate hardening or curing of the foamed polymer material, the mold may be opened to allow removal of the formed modular unit. For example the lid of the mold may be unclamped and opened. The mold may remain assembled, and the lid may simply be removed from a mold box of the mold, or may pivot about hinges to an open position. In other words, the mold need not be disassembled to remove the modular building unit. As noted above, in one embodiment, removing the modular building unit from the mold may include injecting air within the mold beneath the foamed polymer material of the modular building unit to raise the modular building unit at least partially out of the mold.

As noted above, the mold may form each modular building unit with a taper on the outer or side walls and/or in the center columns (e.g., the inner walls), at a point to allow further release of the block where the bond beam clears the mold. The taper forms a lower portion of the block to have a thickness that is smaller than a thickness of an upper portion of the block. This makes it possible to remove the block from the molds with ease and without damaging the block. This slight taper in the mold, which is reflected in each block, allows for rapid manufacturing and decreases a possibility that a block will be damaged during the manufacturing process. Removing the modular building unit may include raising the block up and out of the mold using compressed air until the block reaches a point where a support structure begins to clear the mold and air pressure within the mold is lost. The mold may include the taper to be at a point where a bottom of the modular building unit may reach and/or clear the taper in the mold substantially contemporaneous with the support structure clearing the mold and air pressure being lost.

Using Modular Building Units to Construct Structures

Methods of constructing structures are also provided by the present disclosure. The methods of constructing structures may include stacking and/or interlocking a plurality of modular building units, according to the present disclosure, to erect an ICF. The ICF provides a form for pouring concrete to construct the structure. The ICF is integrated into the concrete structure (e.g., a wall system of modular building units and concrete, optionally reinforced).

In one embodiment of a method of constructing a concrete structure, a plurality of modular building units are stacked and/or interconnected to erect an insulated concrete form. The modular building units may be formed of a foamed polymer material, such as polyurethane. Each modular building unit may at least partially define a vertical column cavity and at least partially define a horizontal beam cavity that intersects the vertical column cavity. Stacking and/or interlocking the modular building units may include aligning the vertical column cavity and the horizontal beam cavity of each modular building unit with an adjacent modular building unit.

The plurality of modular building units are configured to receive concrete in a liquid state and to form the concrete into a plurality of discrete columns extending vertically through the plurality of modular building units. The concrete fills aligned vertical column cavities of stacked modular building units and forms the concrete into a column that extends through the stacked modular building units. The plurality of modular building units may form a plurality of columns.

The plurality of modular building units are also configured to form concrete into a plurality of discrete beams (e.g., bond beams) extending horizontally through the plurality of modular building units. The concrete fills aligned horizontal beam cavities of adjacent interlocked modular building units and forms the concrete into a beam that extends through the adjacent interlocked modular building units. The plurality of modular building units may form a plurality of beams, each extending horizontally and intersecting one or more columns.

The light weight and interlocking tongue and groove interconnections allow modular building units to be quickly and easily fitted and interlocked together by properly inserting each block's tongue(s) into the groove(s) of any blocks adjacent to and/or lower than the block. The blocks may be designed in a manner that, when stacked and interlocked, or otherwise fitted together, the interior columns automatically line up even though the blocks may be arranged in a staggered stacked arrangement. The outside appearance of the interlocked block is therefore the same as tongue and groove brick walls, while the interior columns for cement to be poured all line up perfectly. The tongue and groove on the top and bottom of each block are a minimum of one inch in height and depth. This prevents the block from lifting or shifting in any way while being filled with concrete. The tongue and groove are straight without any taper, which allows for a tighter and firmer fit as the blocks are joined.

In certain embodiments, vertical column cavities more toward an end of a block may be sized smaller than more interior vertical column cavities more in the center of each block. This design may facilitate alignment of the vertical column cavities when stacking the blocks in a staggered configuration.

Once the plurality of modular building units are stacked and interlocked as appropriate to erect an ICF, reinforcement material may be positioned within the ICF to reinforce the ultimate structure. Reinforcement material, such as rebar, may be positioned within the aligned vertical column cavities prior to pouring concrete therein to reinforce the concrete column. Reinforcement material, such as rebar, may be positioned within the aligned horizontal beam cavities prior to pouring concrete therein to reinforce the concrete beam.

Concrete in a liquid state may be poured into the ICF and allowed to cure to form the columns and beams of the desired structure. The use of aerated, light weight concrete may facilitate the insulation properties inherent in the modular building units. For example, polyurethane modular building units may provide insulation properties that are superior to presently available foam blocks used in ICFs. Cement filled walls constructed according to the disclosed embodiments may achieve significantly higher insulation capacities and noise reduction than traditional constructed walls. Such walls may also provide sheer strength in case of an earthquake, because of their flexibility.

The design of the blocks also contemplates and facilitates corners and intersecting walls in a seamless pattern that looks natural. A separate mold may be used for forming end and corner blocks, which may have no tongue and groove at one end.

The presently disclosed embodiments enable molding foam modular building units in sizes over 8"×8"×32", including but not limited to modular units with 8"×12"×40" dimensions, 12"×12"×48" dimensions, and 16"×16"×48" dimensions. For example, the presently disclosed embodiments enable injection molding foamed polyurethane modular building units in sizes over 8"×8"×32", including but not limited to modular units with 8"×12"×40" dimensions, 12"×12"×48" dimensions, and 16"×16"×48" dimensions.

As will be readily understood, the components of the embodiments as generally described and illustrated in the figures herein could be arranged and designed in a wide variety of configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element.

Figure 1B:
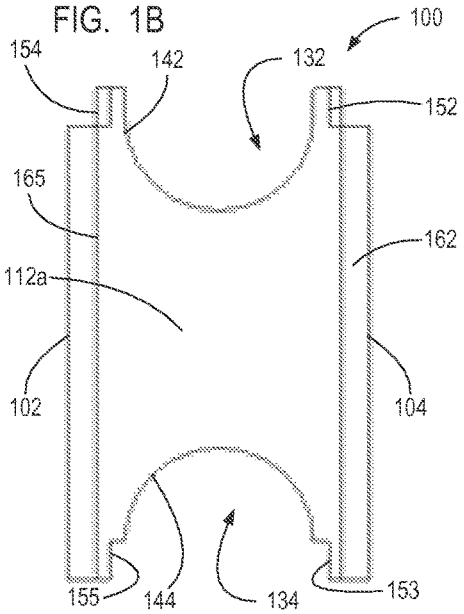
FIG. 1B is a right elevation view of the modular building unit of FIG. 1A.
Figure 1C:
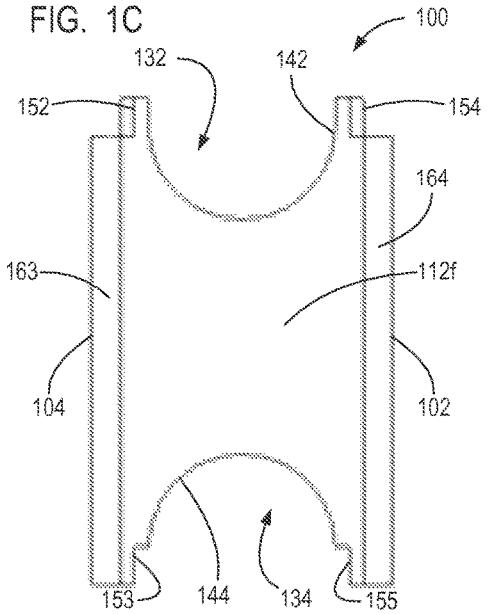
FIG. 1C is a left elevation view of the modular building unit of FIG. 1A.
Figure 1D:
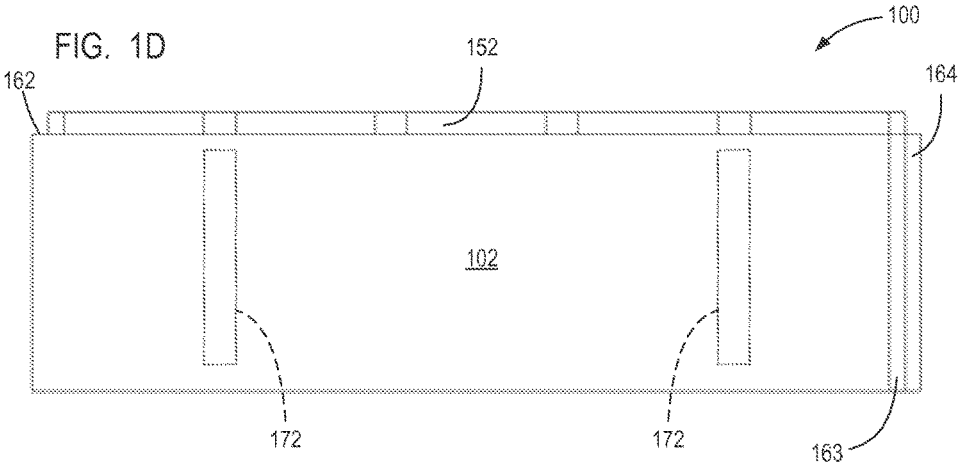
FIG. 1D is a front elevation view of the modular building unit of FIG. 1A.
Figure 1E:
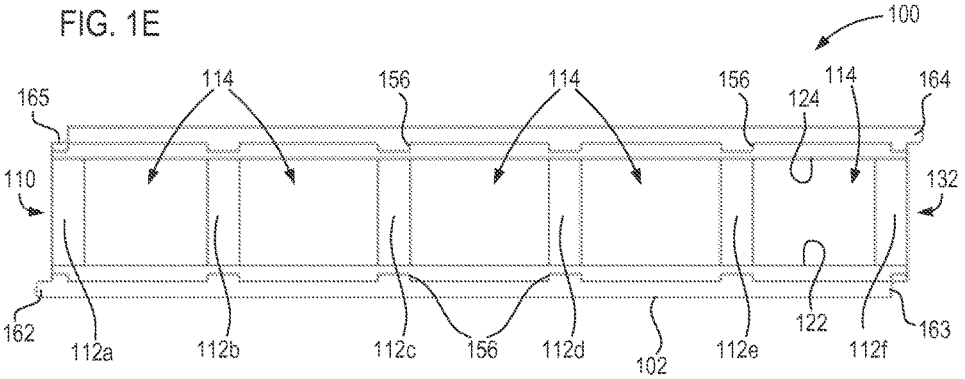
FIG. 1E is a top elevation view of the modular building unit of FIG. 1A.
Figure 1F:
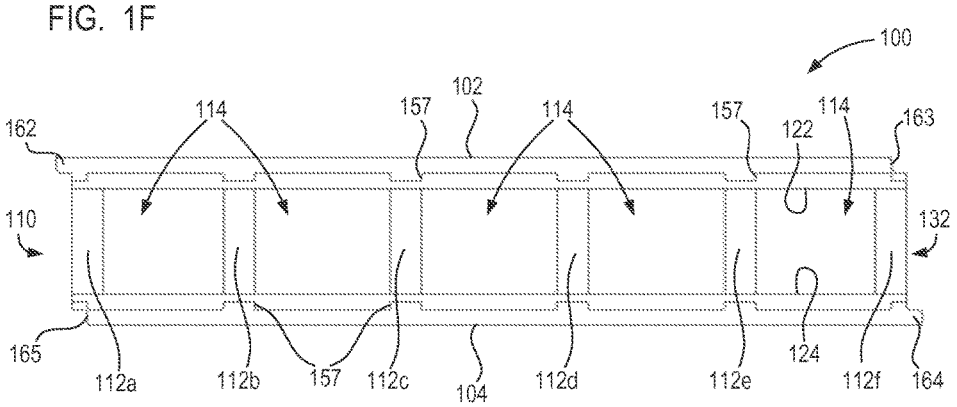
FIG. 1F is a bottom elevation view of the modular building unit of FIG. 1A.

FIGS. 1A-1F provide various views of a modular building unit 100, according to one embodiment of the present disclosure. Specifically, FIG. 1A is a perspective view of the modular building unit 100. FIG. 1B is a right elevation view of the modular building unit 100. FIG. 1C is a left elevation view of the modular building unit 100. FIG. 1D is a front elevation view of the modular building unit 100. FIG. 1E is a top elevation view of the modular building unit 100. FIG. 1F is a bottom elevation view of the modular building unit 100.

Referring to FIGS. 1A-1F generally and collectively, the modular building unit 100 is a foam block for erecting insulating concrete forms to construct structures. The modular building unit 100 includes a front panel 102, a back panel 104, and a web 110 of a plurality of support members 112*a*, 112*b*, 112*c*, 112*d*, 112*e*, 112*f* (also generally or collectively designated 112).

The front panel 102 provides a front face of the modular building unit 100. The front panel 102 is formed of a foamed polymer material, such as foamed polyurethane. The front panel includes an inner surface 122 to provide a form for concrete when poured into the modular building unit 100. The front panel 102 includes a top interconnect that is a top tongue 152 (or narrow ridge) disposed at a top of the front panel 102 and a bottom interconnect that is a bottom groove 153 (or slot) disposed at a bottom of the front panel 102. The top tongue 152 is configured to interconnect with a bottom groove of a front panel of another modular building unit stacked on top of the illustrated modular building unit 100. Similarly, the bottom groove 153 is configured to interconnect with a top tongue of a front panel of another modular building unit on which the illustrated modular building unit 100 is stacked. The top tongue 152 may include protrusions 156 that may align with notches 157 in the bottom groove 153 to facilitate alignment of vertical column cavities 114 of stacked modular building units 100. The front panel 102 also includes a lateral interconnect that is a lateral tongue 162 disposed at a first end of the front panel 102 and a lateral interconnect that is a lateral groove 163 disposed at a second end of the front panel 102. The lateral tongue 162 is configured to interconnect with a lateral groove of an adjacent modular building block and the lateral groove 163 is configured to interconnect with at lateral tongue of another adjacent modular building block.

The back panel 104 provides a back face of the modular building unit 100. The back panel 104 is formed of the foamed polymer material, such as polyurethane. The back panel 104 includes an inner surface 124 to provide a form for concrete when poured into the modular building unit 100. The back panel 104 includes a top interconnect that is a top tongue 154 disposed at a top of the back panel 104 and a bottom interconnect that is a bottom groove 155 disposed at a bottom of the back panel 104. The top tongue 154 is configured to interconnect with a bottom groove of back panel of another modular building unit stacked on top of the illustrated modular building unit 100. Similarly, the bottom groove 155 is configured to interconnect with a top tongue of a back panel of another modular building unit on which the illustrated modular building unit 100 is stacked. The top tongue 154 may include protrusions 156 that may align with notches 157 in the bottom groove 155 to facilitate alignment of vertical column cavities 114 of stacked modular building units 100. The back panel 104 also includes a lateral interconnect that is a lateral tongue 164 disposed at a second end of the back panel 104 and a lateral interconnect that is a lateral groove 165 disposed at a first end of the back panel 102. The lateral tongue 164 is configured to interconnect with a lateral groove of a back panel of an adjacent modular building block and the lateral groove 165 is configured to interconnect with a lateral tongue of a back panel of another adjacent modular building block.

The front panel 102 and the back panel 104 are connected by the web 110. The web 110 includes the plurality of support members 112. The plurality of support members are also formed of the foamed polymer material, such as polyurethane. The plurality of support members 112 are formed together with the front panel 102 and the back panel 105 by a single injection molding process. In other words, the entire modular building unit 100 is formed in a single mold by a single injection molding process. The plurality of support member 112 extend between and couple the inner surface 122 of the front panel 102 to the inner surface 124 of the back panel 104.

The plurality of support members 112 are spaced from each other to at least partially define one or more vertical column cavities 114 between the front panel 102 and the back panel 104 and extending within the modular building unit 100 from a top opening at a top of the modular building unit 100 to a bottom opening at a bottom of the modular building unit 100. In the illustrated embodiment of a modular building unit 100, at least one support member 112*a* is disposed at an end of the front panel 102 and at an end of the back panel 104 and forms an end of the modular building block 100. The modular building unit 100 also includes a second support member 112*f* that is disposed at a second end of the front panel 102 and at a second end of the back panel 104 and forms a second end of the modular building block 100.

The plurality of support members 112 also at least partially define an upper horizontal beam cavity 132 between the front panel 102 and the back panel 104. The horizontal beam cavity 132 extends along a length of the modular building unit 100 to intersect with the one or more vertical column cavities 114. In the illustrated embodiment, a top of each of the plurality of support members 112 includes an inward offset 142, which may be a gap or vertical depression, to at least partially define the upper horizontal beam cavity 132. In the illustrated embodiment, the inward offset 142 is a semi-circle shape. The semi-circle shaped inward offset 142 at a top of a given support member cooperates with an inward offset at a bottom of a support member of another modular building unit stacked on top of the modular building unit 100. The inward offset 142 cooperates with an inward offset at a bottom of a support member of the another modular building unit to more fully define the upper horizontal beam cavity 132 to have a circular cross-section.

The plurality of support members 112 also at least partially define a lower horizontal beam cavity 134 between the front panel 102 and the back panel 104 and extending along a length of the modular building unit 100 to intersect with the one or more vertical column cavities 114. In the illustrated embodiment, a bottom of each of the plurality of support members 112 includes an inward offset 144, which may be a gap or vertical depression, to at least partially define the lower horizontal beam cavity 134. In the illustrated embodiment, the inward offset 144 is a semi-circle shape. The semi-circle shaped inward offset 142 at a bottom of a given support member cooperates with an inward offset at a top of a support member of another modular building unit on which the modular building unit 100 is stacked. The inward offset 144 cooperates with the inward offset of the another modular building unit to at least partially define the lower horizontal beam cavity 134 to have a circular cross-section.

Described differently, each support member 112*a*, 112*b*, 112*c*, 112*d*, 112*e*, 112*f* includes a first (e.g., bottom) inward offset 144, or vertical depression (e.g., a gap), disposed in a bottom surface of the support member 112*a*, 112*b*, 112*c*, 112*d*, 112*e*, 112*f* that at least partially defines a lower horizontal beam cavity 134 and a second (e.g., upper) inward offset 142, or vertical depression (e.g., a gap), disposed in a top surface of the support member 112*a*, 112*b*, 112*c*, 112*d*, 112*e*, 112*f* that at least partially defines an upper horizontal beam cavity 132.

The modular building unit 100 is configured to stack on top of a second modular building unit to erect an ICF. The modular building unit 100 stacks on top of the second modular building unit so that at least one vertical column cavity 114 is aligned with a vertical column cavity of the second modular building unit to form a column of concrete when concrete is poured into the ICF. The concrete column that is formed extends from a bottom opening of the vertical column cavity of the second modular building unit to the top opening of the vertical column cavity 114 of the modular building unit 100.

The upper horizontal beam cavity 132 at least partially forms a beam of concrete (e.g., a bond beam) when concrete is poured into the ICF and/or modular building unit 100. The beam extends along a length of the modular building unit 100 and intersects with the columns of concrete formed by the vertical column cavities 114. Similarly, the lower horizontal beam cavity 134 at least partially forms a beam of concrete (e.g., a bond beam) when concrete is poured into the ICF and/or modular building unit 100. This lower beam extends along a length of the modular building unit 100 and intersects with the columns of concrete formed by the vertical column cavities 114. The lower horizontal beam cavity 134 cooperates with an upper horizontal beam cavity of a second modular building unit, on which the modular building unit 100 is stacked, to at least partially define a full horizontal beam cavity that forms the beam of concrete. A beam of concrete formed by either the lower horizontal beam cavity 134 or the upper horizontal beam cavity 132 of the modular building unit 100 in cooperation with a horizontal beam cavity of another modular building unit is cylindrical, having a circular transverse cross-section. In other words each upper horizontal beam cavity 132 is configured to form a bottom half (or approximately half) of a concrete beam in a structure and each lower horizontal beam cavity 134 is configured to form a top half (or other approximately half) of the concrete beam.

One or more wood strips 172 may be embedded within at least one of the front panel 102 and the back panel 104 of the modular building unit 100. The wood strips 172 are configured to receive and retain screws inserted into the modular building unit for providing finishing to a structure constructed with the modular building unit 100. The wood strips 172 may be fully enclosed within the foamed polymer material, such that they are shielded from moisture and other elements. The wood strips 172 may be configured to be inserted into the mold that forms the modular building unit to embed the wood strips 172 in the modular building unit, fully encased in foamed polymer material.

The modular building unit 100, including the vertical column cavities 114 and the horizontal beam cavities 132, 134 (i.e., the inward offsets 142, 144 of the support members 112), is formed in a single mold by a single injection molding process. The modular building unit 100 is removed from the mold in a completed, usable state to form both columns and beams of concrete.

Figure 2D:
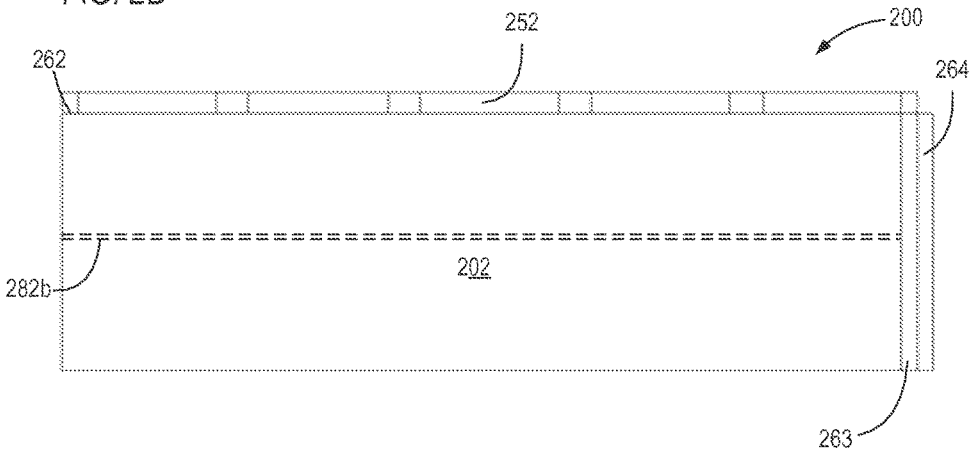
FIG. 2D is a front elevation view of the modular building unit of FIG. 2A.
Figure 2E:
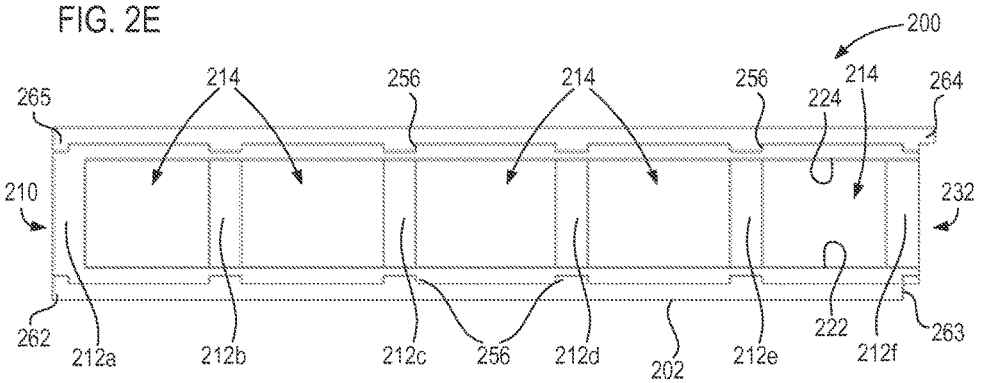
FIG. 2E is a top elevation view of the modular building unit of FIG. 2A.
Figure 2F:
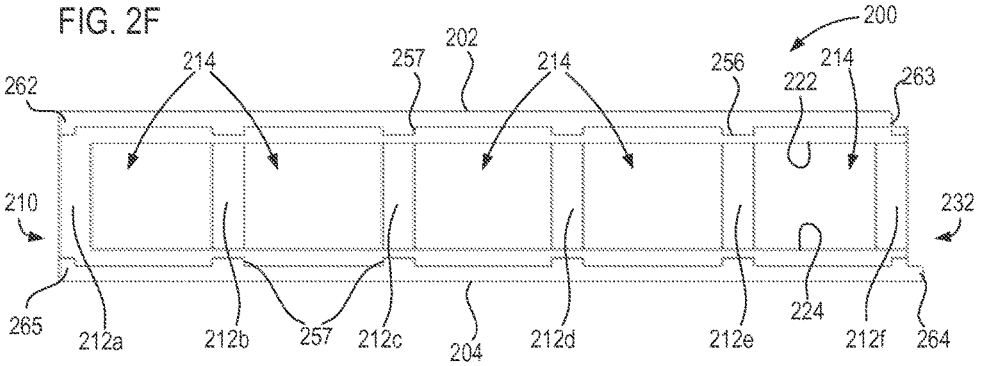
FIG. 2F is a bottom elevation view of the modular building unit of FIG. 2A.

FIGS. 2A-2G provide various views of a modular building unit 200, according to another embodiment of the present disclosure. The modular building unit 200 is an end or corner More specifically, FIG. 2A is a perspective view of the modular building unit 200. FIG. 2B is a right elevation view of the modular building unit 200. FIG. 2C is a left elevation view of the modular building unit 200. FIG. 2D is a front elevation view of the modular building unit 200. FIG. 2E is a top elevation view of the modular building unit 200. FIG. 2F is a bottom elevation view of the modular building unit 200. FIG. 2G is a close-up view of one or more tapers 282*a*, 282*b* (also generally or collectively designated 282) in one or more vertical surfaces of the modular building unit 200.

Referring to FIGS. 2A-2F generally and collectively, the modular building unit 200 is a foam block for erecting insulating concrete forms to construct structures. The modular building unit 200 includes a front panel 202, a back panel 204, and a web 210 of a plurality of support members 212*a*, 212*b*, 212*c*, 212*d*, 212*e*, 212*f* (also generally or collectively designated 212). The one or more tapers 282 are formed in vertical surfaces of one or more of the front panel 202 and the back panel 204. The tapers 282 may facilitate ejection and/or removal of the modular building unit 200 from a mold that forms the modular building unit 200.

The front panel 202 provides a front face 203 of the modular building unit 200. The front face 203 includes the taper 282*a*. The front panel 202 is formed of a foamed polymer material, such a foamed polyurethane. The front panel 202 includes an inner surface 222 to provide a form for concrete when poured into the modular building unit 200. The front panel 202 includes a top interconnect that is a top tongue 252 disposed at a top of the front panel 202 and a bottom interconnect that is a bottom groove 253 disposed at a bottom of the front panel 202. The top tongue 252 is configured to interconnect with a bottom groove of a front panel of another modular building unit stacked on top of the illustrated modular building unit 200. Similarly, the bottom groove 253 is configured to interconnect with a top tongue of a front panel of another modular building unit on which the illustrated modular building unit 200 is stacked. The top tongue 252 may include protrusions 256 that may align with notches 257 in the bottom groove 253 to facilitate alignment of vertical column cavities 214 of stacked modular building units 200. The front panel 202 also includes a lateral interconnect that is a lateral tongue 262 disposed at a first end of the front panel 202 and a lateral interconnect that is a lateral groove 263 disposed at a second end of the front panel 202. The lateral tongue 262 is configured to interconnect with a lateral groove of an adjacent modular building block and the lateral groove 263 is configured to interconnect with at lateral tongue of another adjacent modular building block.

The back panel 204 provides a back face of the modular building unit 200. A taper 282*a* is disposed in the back face of the modular building unit 200. The back panel 204 is formed of the foamed polymer material, such as polyurethane. The back panel 204 includes an inner surface 224 to provide a form for concrete when poured into the modular building unit 200. The back panel 204 includes a top interconnect that is a top tongue 254 disposed at a top of the back panel 204 and a bottom interconnect that is a bottom groove 255 disposed at a bottom of the back panel 204. The top tongue 254 is configured to interconnect with a bottom groove of back panel of another modular building unit stacked on top of the illustrated modular building unit 200. Similarly, the bottom groove 255 is configured to interconnect with a top tongue of a back panel of another modular building unit on which the illustrated modular building unit 200 is stacked. The top tongue 254 may include protrusions 256 that may align with notches 257 in the bottom groove 255 to facilitate alignment of vertical column cavities 214 of stacked modular building units 200. The back panel 204 also includes a lateral interconnect that is a lateral tongue 264 disposed at a second end of the back panel 204 and a lateral interconnect that is a lateral groove 265 disposed at a first end of the back panel 202. The lateral tongue 264 is configured to interconnect with a lateral groove of a back panel of an adjacent modular building block and the lateral groove 265 is configured to interconnect with a lateral tongue of a back panel of another adjacent modular building block.

The front panel 202 and the back panel 204 are connected by the web 210. The web 210 includes the plurality of support members 212. The plurality of support members are also formed of the foamed polymer material, such as polyurethane. The plurality of support members 212 are formed together with the front panel 202 and the back panel 204 by a single injection molding process. In other words the entire modular building unit 200 is formed in a single mold by a single injection molding process. The plurality of support member 212 extend between and couple the inner surface 222 of the front panel 202 to the inner surface 224 of the back panel 204.

The plurality of support members 212 are spaced from each other to at least partially define one or more vertical column cavities 214 between the front panel 202 and the back panel 204 and extending within the modular building unit 200 from a top opening at a top of the modular building unit 200 to a bottom opening at a bottom of the modular building unit 200. In the illustrated embodiment of a modular building unit 200, at least one support member 212*a* is disposed at an end of the front panel 202 and at an end of the back panel 204 and forms an end of the modular building block 200. The modular building unit 200 also includes a second support member 212*f* that is disposed at a second end of the front panel 202 and at a second end of the back panel 204 and forms a second end of the modular building block 200.

The plurality of support members 212 also at least partially define an upper horizontal beam cavity 232 between the front panel 202 and the back panel 204 and extending along a length of the modular building unit 200 to intersect with the one or more vertical column cavities 214. In the illustrated embodiment, a top of each of the plurality of support members 212 includes an inward offset 242, which may be a gap or vertical depression, to at least partially define the upper horizontal beam cavity 232. In the illustrated embodiment, the inward offset 242 is a semi-circle shape. The semi-circle shaped inward offset 242 at a top of a given support member cooperates with an inward offset at a bottom of a support member of another modular building unit stacked on top of the modular building unit 200. The inward offset 242 cooperates with the inward offset of the another modular building unit to at least partially define the upper horizontal beam cavity 232 to have a circular cross-section.

The plurality of support members 212 also at least partially define a lower horizontal beam cavity 234 between the front panel 202 and the back panel 204 and extending along a length of the modular building unit 200 to intersect with the one or more vertical column cavities 214. In the illustrated embodiment, a bottom of each of the plurality of support members 212 includes an inward offset 244, which may be a gap or vertical depression, to at least partially define the lower horizontal beam cavity 234. In the illustrated embodiment, the inward offset 244 is a semi-circle shape. The semi-circle shaped inward offset 242 at a bottom of a given support member cooperates with an inward offset at a top of a support member of another modular building unit on which the modular building unit 200 is stacked. The inward offset 244 cooperates with the inward offset of the another modular building unit to at least partially define the lower horizontal beam cavity 234 to have a circular cross-section.

Described differently, several of the support members 212*b*, 212*c*, 212*d*, 212*e*, 212*f* include a first inward offset 244, or vertical depression (e.g., a gap), disposed in a bottom surface of the support members 212*b*, 212*c*, 212*d*, 212*e*, 212*f* that at least partially defines a lower horizontal beam cavity 234 and a second inward offset 242, or vertical depression (e.g., a gap), disposed in a top surface of the several of the support members 212*b*, 212*c*, 212*d*, 212*e*, 212*f* that at least partially defines an upper horizontal beam cavity 232. Different from the modular building unit 100 of FIG. 1, the modular building unit 200 of FIG. 2 includes an end support member 212*a* that does not include an inward offset 242, 244. Accordingly, the modular building unit 200 can function as an end block or corner block in constructing a structure, to retain liquid concrete within the modular building unit 200 and keep the liquid concrete from pouring out.

The modular building unit 200 is configured to stack on top of a second modular building unit to erect an ICF. The modular building unit 200 stacks on top of the second modular building unit so that at least one vertical column cavity 214 is aligned with a vertical column cavity of the second modular building unit to form a column of concrete when concrete is poured into the ICF. The concrete column that is formed extends from a bottom opening of the vertical column cavity of the second modular building unit to the top opening of the vertical column cavity 214 of the modular building unit 200.

The upper horizontal beam cavity 232 at least partially forms a beam of concrete (e.g., a bond beam) when concrete is poured into the ICF and/or modular building unit 200. The beam extends along a length of the modular building unit 200 and intersects with the columns of concrete formed by the vertical column cavities 214. Similarly, the lower horizontal beam cavity 234 at least partially forms a beam of concrete (e.g., a bond beam) when concrete is poured into the ICF and/or modular building unit 200. This lower beam extends along a length of the modular building unit 200 and intersects with the columns of concrete formed by the vertical column cavities 214. The lower horizontal beam cavity 234 cooperates with an upper horizontal beam cavity of a second modular building unit, on which the modular building unit 200 is stacked, to more fully define a horizontal beam cavity that forms the beam of concrete. A beam of concrete formed by either the lower horizontal beam cavity 234 or the upper horizontal beam cavity 232 of the modular building unit 200 in cooperation with a horizontal beam cavity of another modular building unit is cylindrical, having a circular transverse cross-section.

The modular building unit 200, including the vertical column cavities 214 and the horizontal beam cavities 232, 234 (i.e., the inward offsets 242, 244 of the support members 212), is formed in a single mold by a single injection molding process. The modular building unit 200 is removed from the mold in a completed, usable state to form both columns and beams of concrete.

As can be appreciated, the modular units 100, 200 shown in the foregoing FIGS. 1A-1F and FIGS. 2A-2G, respectively, are merely examples of embodiments, according to the present disclosure. Other configurations are possible and within the scope of the present disclosure. For example, the tongue and groove interconnects may be configured differently such that the tongue is disposed on a bottom of the front panel and/or rear panel and the groove is disposed on a top of the front panel and/or rear panel.

The vertical column cavities 114, 214 have a square, or square-like, cross-section. In other embodiments, the vertical column cavities 114, 214 may have a cross-section of another shape, such as a circle, a rectangle, a square, etc. A number of vertical column cavities 114, 214 may vary. Instead of four vertical column cavities 114, 214, a modular building unit according to the present disclosure may have two, or three, or five, etc. Similarly, the horizontal beam cavities 132, 134, 232, 234 may have a cross-section of another shape. In certain embodiments, a horizontal beam cavity may be divided within a single modular building unit, such that a first horizontal beam cavity extends a first portion of a length of the modular building unit and ends at an internal support member and a second horizontal beam cavity extends a second portion of the length of the modular building unit. A number of horizontal beam cavities 132, 134, 232, 234 may vary.

Figure 3:
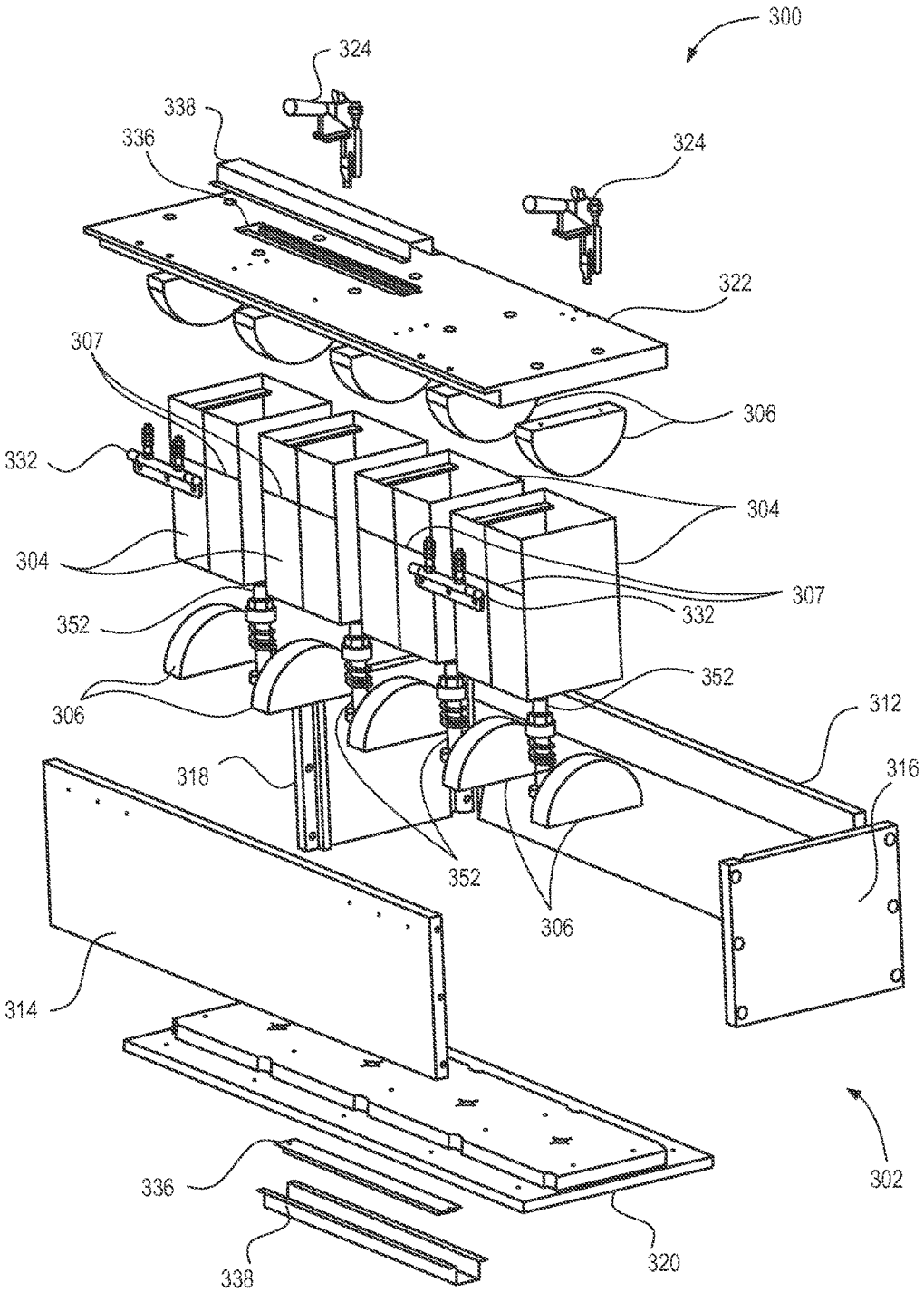
FIG. 3 is an exploded rear view of a mold for manufacture of a modular building unit, according to one embodiment.

FIG. 3 is an exploded rear view of a mold 300 for manufacturing, molding, or otherwise forming a modular building unit, according to one embodiment. For example, the mold 300 may be used to mold a modular building unit similar to the modular building units 100, 200 of FIGS. 1A and 2A. The mold 300 may form a foamed polymer material into a modular building unit to be to be used for erecting insulated concrete forms to construct a concrete structure. In FIG. 3, the mold includes a mold box 302, a plurality of column cores 304, and a plurality of beam cores 306. The column cores 304 and beam cores 306 are positioned in the mold box 302 and two or more compounds, either individually or as a mixture, can be injected or otherwise deposited in the mold box 302. The compounds chemically react to produce a foaming mixture that expands to fill the mold box 302, around the column cores 304 and beam cores 306, and cure to a foamed polymer material in a desired shape of a modular building unit.

The mold box 302 includes a front side plate 312, a back side plate 314, a first (e.g., left) end plate 316, a second (e.g., right) end plate 318, a base 320, and a lid 322. The front side plate 312 provides a front side of the mold box 302 and forms an outer surface (or front face) of a front panel of a modular building unit. The back side plate 314 provides a back side of the mold box 302 and forms an outer surface (or rear face) of a back panel of the modular building unit. The first end plate 316 couples a first end of the front side plate 312 and a first end of the back side plate 314 to provide a first end of the mold box 302. The first end plate 316 forms a first end surface of the front panel and the back panel of the modular building unit formed by the mold 300 and forms an outer surface of a first end support member that couples the front panel and the back panel of the modular building unit. The second end plate 318 couples a second end of the front side plate 312 and a second end of the back side plate 314 and provides a second end of the mold box 302. The second end plate 318 forms a second end surface of the front panel and the back panel of the modular building unit formed by the mold 300 and forms an outer surface of a second end support member that couples the front panel and the back panel of the modular building unit. The base 320 provides a bottom of the mold box 302 and forms a bottom surface of the front panel and the back panel of the modular building unit formed by the mold 300.

The lid 322 provides a top of the mold box 302 and forms a top surface of the front panel and the back panel of the modular building unit 300. In FIG. 3, the lid 322 couples to the back side plate 314 with hinges 332, which allow the lid 322 to pivot between a closed position (in engagement with each of the front side plate 312, the back side plate 314, the first end plate 316, and the second end plate 318) and an open position that allows removal of the formed modular block from the mold 300. One or more latches 324 may be coupled to the lid and the front side plate 312 to enable clamping of the lid 322 or otherwise secure the lid 322 in the closed position.

The front side plate 312, the back side plate 314, the first end plate 316, the second end plate 318, the base 320, and the lid 322 are coupled together to form an air-tight mold box 302.

In some embodiments, an inner surface of the front side plate 312 and an inner surface of the rear side plate 314 may include a taper that narrows a bottom portion of a modular building unit as compared to a top portion of a modular building unit.

The plurality of column cores 304 are configured to be positioned within the mold box 302 to at least partially form a plurality of support members that couple the front panel and the back panel of the modular building unit formed in the mold 300. Each column core 304 is configured to at least partially form an inner surface of the front panel of the modular building unit and an inner surface of the back panel of the modular building unit. Each column core 304 also defines an inner surface of a first end support member, an inner surface of a second end support member, and/or a vertical surface of an inner support member. The column cores 304 are disposed within the mold box 302 and extend from the base 320 to the lid 322, so as to form vertical column cavities within the modular building unit formed within the mold 300. The column cores 306 may each have the same dimensions, or may have varying dimensions. In the illustrated embodiment 304, the column cores 304 are hollow.

The column cores 306 may include a taper 307 configured to provide a reflective taper on an inner surface of one or both of the front panel and the back panel. The taper 307 narrows a thickness of a bottom portion of the front panel and/or the back panel relative to a thickness of a top portion of the front panel and/or the back panel. The taper 307 may facilitate removal of a modular building unit from the mold 300.

The mold 300 also includes an air system to inject air into a bottom of the mold 300 beneath a formed modular building unit to eject it. The air system may include a plurality of hollow spring pins 352 that facilitate injection of air at the bottom of the mold 302 beneath the modular building unit, as will be discussed below in greater detail with reference to FIGS. 4A and 4B.

The plurality of beam cores 306 are coupled to one of the lid 322 and the base 320. In FIG. 3, the beam cores 306 are a solid semicircle shape. The beam cores 306 coupled to the lid 322 form inward offsets in a top of the support members of the modular building unit formed by the mold 300. The inward offsets formed by the beam cores 306 coupled to the lid 322 at least partially define an upper horizontal beam cavity of the modular building unit. Similarly, the beam cores 306 coupled to the base 320 form inward offsets in a bottom of the support members of the modular building unit formed by the mold 300. The inward offsets formed by the beam cores 306 coupled to the base 320 at least partially define a lower horizontal beam cavity of the modular building unit. In other words, the plurality of beam cores 306 are configured to be positioned within the mold box 306 to at least partially form a horizontal beam cavity of the modular building unit. In the mold 300 of FIG. 3, each beam core 306 of a first plurality of beam cores coupled to the lid 322 forms a top surface of a support member, and each beam core 306 of a second plurality of beam cores coupled to the base 320 forms a bottom surface of a support member. The beam cores 306 are configured and positioned to engage a column core 304 to form the horizontal beam cavity to intersect a vertical column cavity of the modular building unit formed by the mold 300.

The beam cores 306 are configured such that approximately half of a full horizontal beam cavity is formed at a top of the modular unit and the other approximately half of a different full horizontal beam cavity is formed at bottom of the modular unit. This configuration enables a substantial reduction in an amount of foaming mixture needed to form the modular units. This saving in material can be substantial. Moreover, the reduced amount of materials can reduce surface tension of a formed modular building unit against surfaces of the mold, which can facilitate removal of the formed modular unit from the mold.

Although the beam cores 306 of FIG. 3 are a solid semicircle shape, other shapes are possible. The beam cores 306 may be any appropriate shape to form an inward offset in a support member to at least partially define a horizontal beam cavity of a modular building unit formed by the mold 300.

The beam cores 306 may be removable from the mold 300 to enable production of corner blocks and other blocks without a horizontal continuous extending horizontal beam cavity.

The mold 300 also includes heater strips 336 and heater covers 338 on one or both of the lid 322 and the base 320. The heater strips 336 can heat the mold 300, which may improve reaction of compounds that produce the foaming mixture and cure to the foamed polymer material. For example, the mold 300 may be maintained at a desired temperature range between 95 degrees Fahrenheit and 125 degrees Fahrenheit. This range may enhance the growth and setting of the polyurethane foam mixture inside the mold 300. The heater covers 338 may shield a user from the heater strips 336.

As can be appreciated, the mold 300 shown in FIG. 3 is one example of an embodiment, according to the present disclosure. Other configurations are possible and within the scope of the present disclosure. For example, the column cores 304 of FIG. 3 have a square, or square-like, cross-section. In other embodiments, the column cores 304 may have a cross-section of another shape, such as a circle, a rectangle, a square, etc. Similarly, the beam cores 306 may have a cross-section of another shape.

Figure 4A:
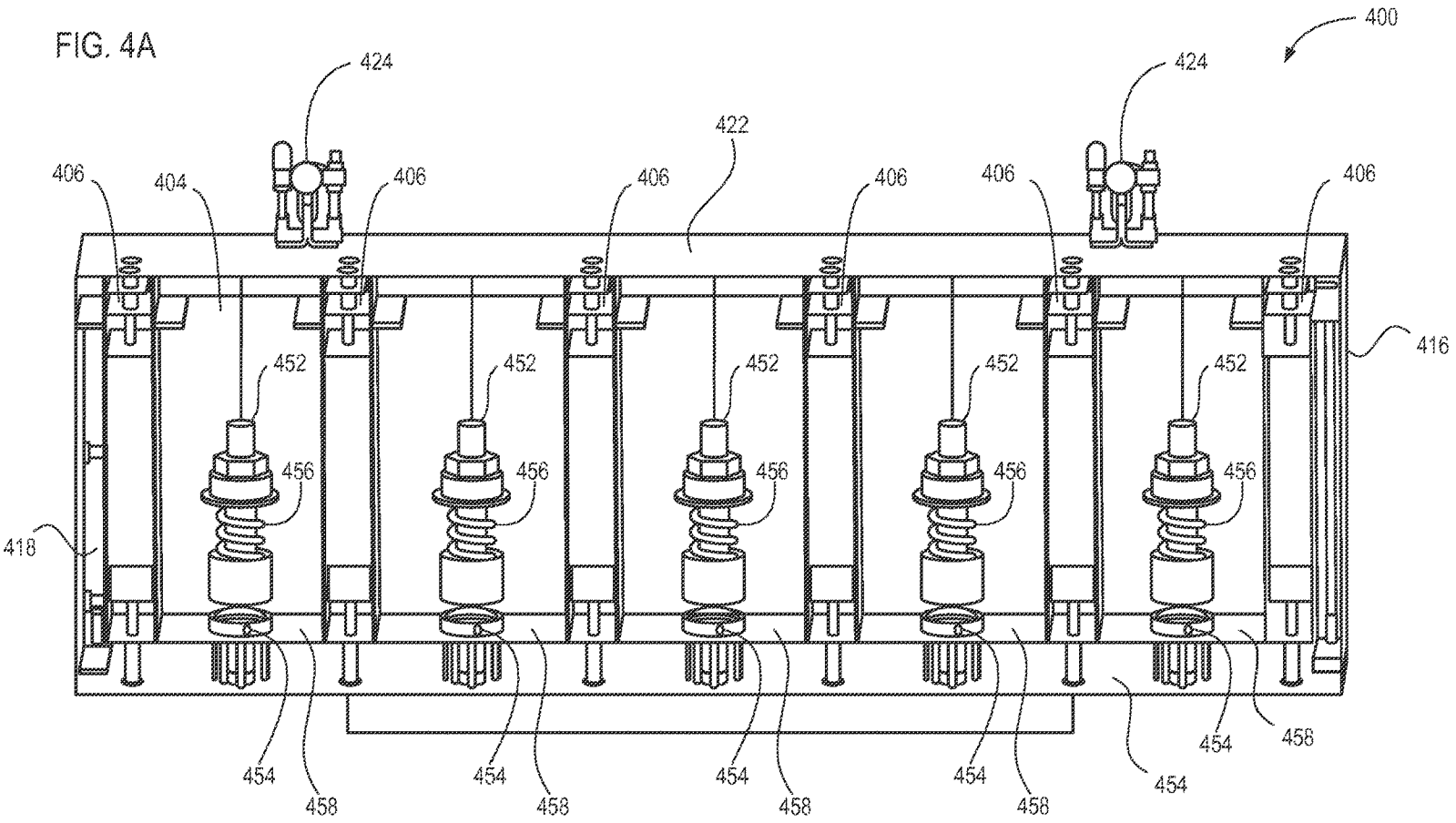
FIG. 4A is a rear sectional view of a mold, according to one embodiment.
Figure 4B:
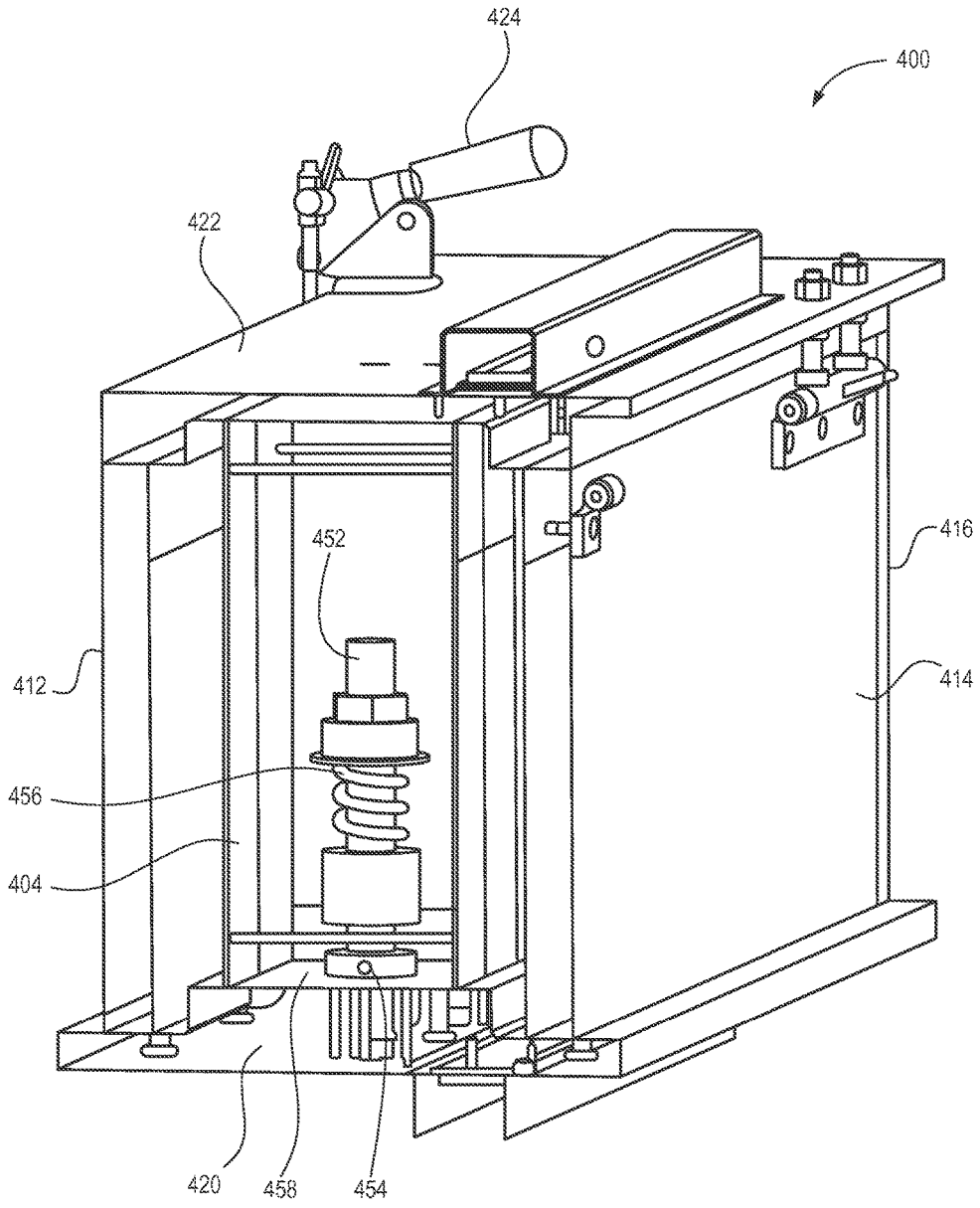
FIG. 4B is a transverse sectional view of a portion of the mold of FIG. 4A.

FIG. 4A is a rear sectional view of a mold 400, according to another embodiment of the present disclosure. FIG. 4B is a transverse sectional view of a portion of the mold 400 of FIG. 4A. Referring generally and collectively to FIGS. 4A and 4B, the mold 400 includes a front side plate (cutaway, but see the front side plate 312 of FIG. 3 for a similar example), a back side plate (not visible, but see the back side plate 314 of FIG. 3 for a similar example), a first end plate 416, a second end plate 418, a base 420, and a lid 422. The lid 422 is secured with the latches 424 in a closed position to contain expansion of a foaming mixture within the mold 400. The sectional view of FIG. 4A also shows the column cores 404, which are hollow and form an air chamber 458 at a bottom of the column core 404.

Disposed within the column cores 404, extending from (or through) the base plate 420 and through the air chambers 458 are a plurality of spring pins 452 of an air system. Compressed air can be injected into the air chamber 458 through an aperture 454 in the spring pins 452. When an air chamber 458 is in an uncompressed state (e.g., with relatively low or no air pressure), a spring 456 secured to the spring pin 452 is biased to force the column core 404 toward the base 420. The spring 456 may secure to the spring pin 452 at a top of the spring 456 and press against a column or seal and/or a ceiling of the air chamber 458. The force of the spring 456 downward on the column core 404 produce an airtight seal of the column core 404 against the base 420. As compressed air is injected into the air chamber 458, air pressure within the air chamber 458 rises to a point that it over comes the force of the spring 456, thereby slightly raising the column core 404 to allow air to escape between a bottom of the column core 404 and the base 420. When a modular building unit is formed within the mold 400, the air released from the chamber is beneath the modular building unit. The air pressure under the modular building unit gradually rises and forces the formed modular building unit to rise out of the mold 400.

The expanded foamed polymer material may create sufficient surface tension against vertical surfaces of the mold 400 to form an airtight seal. The gradually increasing air pressure released under the modular building unit from beneath the column cores 404 creates an air pocket within the mold 400 that gradually expands beneath the modular building unit. Gradual expansion of the air pocket slowly raises the modular unit within the mold. At a point, the support structures of the modular building unit, and particularly an inward offset on a bottom of the support structures, clears a top of the mode and the air pocket loses seal and release air pressure. The drop in air pressure beneath the modular building unit also results in a corresponding drop in pressure within the air chamber 458, which allows the springs 456 to again bias the column cores 404 toward the base 420.

At the point a support member clears the top of the mold, a taper (e.g., taper 332 of FIG. 3) of the mold 400 may facilitate further release of surface tension of the modular building unit.

The release of compressed air, the taper of the mold, and/or a shape and/or configuration of the support members of the modular building unit may enable an even raising of the modular building unit out of the mold 400, decreasing likelihood of breaking the modular building unit during removal from the mold.

As can be appreciated, the present disclosure is not limited to the compressed air system shown in and described with reference to FIGS. 4A and 4B. Any appropriate air system to release compressed air beneath a formed modular building unit may be utilized with a mold, according to the present disclosure.

Figure 5A:
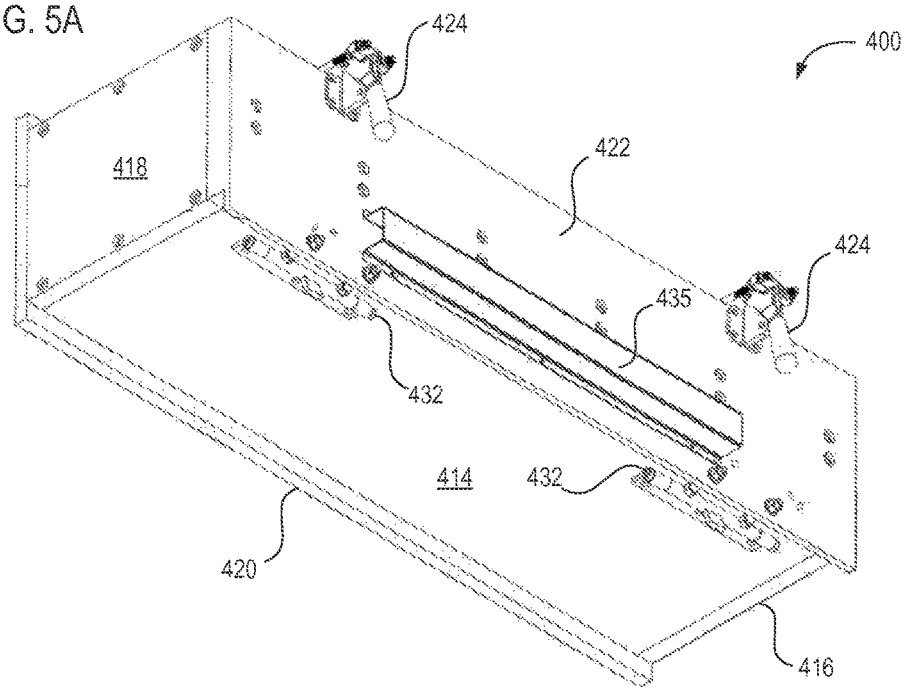
FIG. 5A is a perspective view of a mold for manufacture of a modular building unit, according to one embodiment.
Figure 5B:
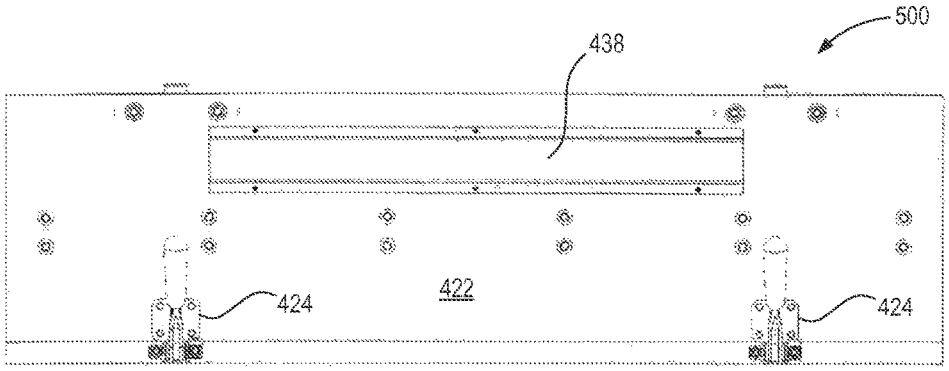
FIG. 5B is a top view of the mold of FIG. 5A.
Figure 5C:
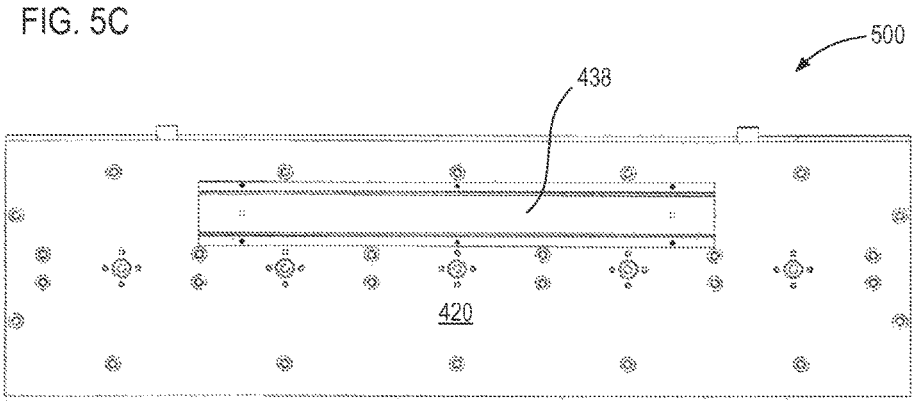
FIG. 5C is a bottom view of the mold of FIG. 5A.
Figure 5D:
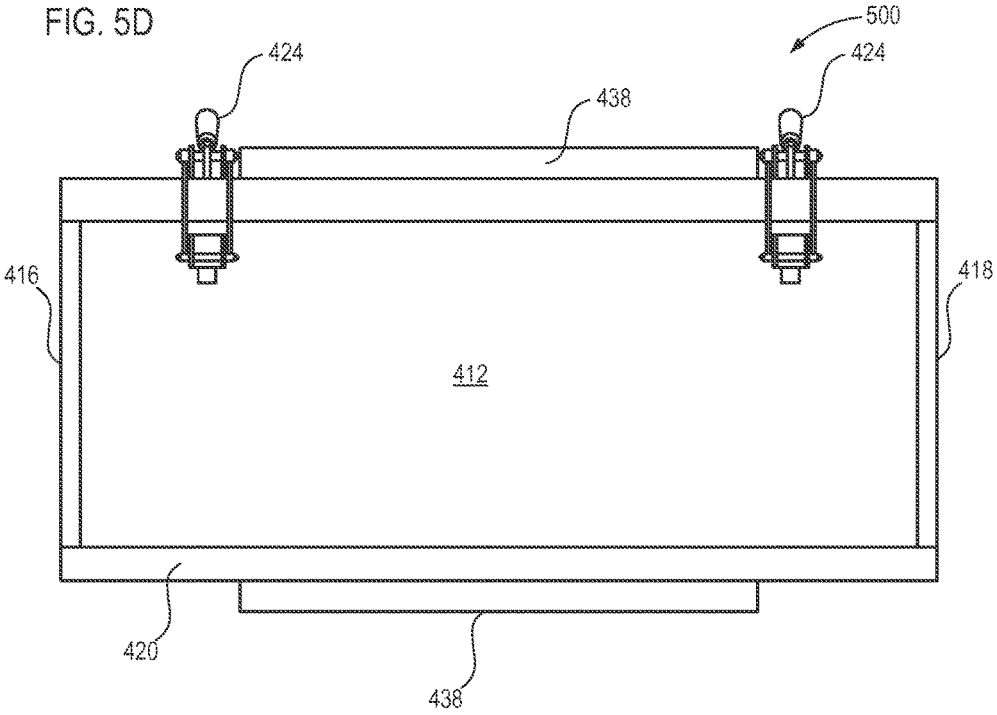
FIG. 5D is a front view of the mold FIG. 5A.

FIGS. 5A-5D provide additional views of the mold 400 of FIG. 4. More specifically, FIG. 5A is a perspective view of the mold 400 for manufacture of a modular building unit. FIG. 5B is a top view of the mold of FIG. 5A. FIG. 5C is a bottom view of the mold of FIG. 5A. FIG. 5D is a front view of the mold FIG. 5A. Referring generally and collectively to FIGS. 5A-5D, the various views show the front side plate 412, the back side plate 414, the first end plate 416, the second end plate 418, the base 420, and the lid 422. The lid 422 is secured with the latches 424 in a closed position to contain expansion of a foaming mixture within the mold 400. A heater cover 438 is disposed on the lid 422.

Figure 6:
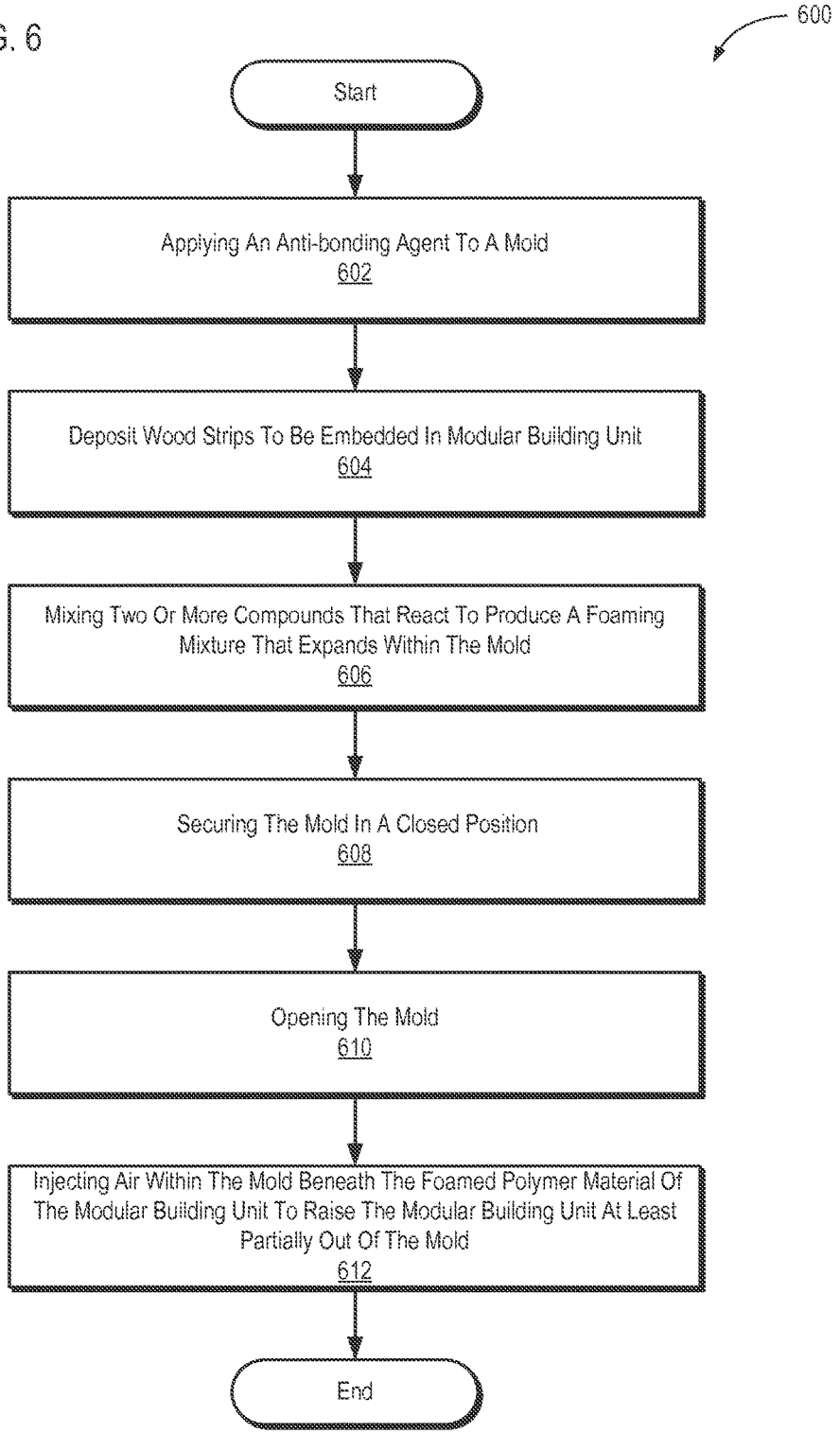
FIG. 6 is a flow diagram of a method of manufacturing a modular building unit, according to one embodiment.

FIG. 6 is a flow diagram of a method 600 of manufacturing a modular building unit, according to one embodiment. An anti-bonding agent may be applied 602 to a mold. The mold may be configured to mold a foamed polymer material into a modular building unit, which may be configured to stack with other modular building units and to provide a form for concrete when poured into the modular building unit. Similar to embodiments of a mold described above, the mold may be configured to mold the modular building unit to define a vertical column cavity and to at least partially define a horizontal beam cavity intersecting the vertical column cavity.

Applying 602 an anti-bonding agent to the mold may include lining the mold with on more sheets of a fluoropolymer, such as polytetrafluoroethylene (PTFE). Anti-bonding agents that may be applied 602 to the mold may include, but are not limited to, sheets of fluoropolymer (e.g., PTFE), fluoropolymer powder, silicone, silicone-based compounds, silane, vegetable oil, soybean oil, light weight motor oil, wax, grease(s), lipids, CrystalCoat MP-313, Silvue Coating (SDC Coatings, Anaheim, Calif.), Iso-Strip-23 Release Coating (ICI Polyurethanes, West Deptford, N.J.), aminoethylaminopropyltrimethoxysilane (Dow Corning Corporation), graphite based lubricants, petroleum based lubricants, tetrafluoroethylene resin, lecithin, resins, proteins, lipids, stearic acid, carbohydrates such as dextrin, and fluorosilicones, and mixtures and combination of one or more of the foregoing. In certain embodiments, applying 602 an anti-bonding agent to the mold includes spraying an anti-bonding agent onto the mold.

Wood strips may be deposited 604 into the mold in a position to be embedded within at least one of the front panel and the back panel of the modular building unit. The wood strips may be deposited into the mold as an "H" shape, configured such that one side is embedded in and extends vertically within the front panel, the other side is embedded in and extends vertically within the back panel, and the cross-member is embedded in and extends through a support member. The "H" shape may have two cross members. The "H" shape may be inserted into a groove within the mold to lock into place and ensure the wood strips remain upright during a foaming reaction within the mold to produce the foamed polymer material. The wood strips can be configured to receive and retain screws inserted into the modular building unit for providing finishing to a structure constructed with the modular building unit.

Two or more compounds are mixed 606 to react within the mold. The compounds, when mixed, react to produce a foaming mixture that expands within the mold. Mixing 606 the two or more compounds may include determining and/or measuring precise amounts of the two or more compounds to produce sufficient foaming mixture to entirely fill the mold, but not so much as to leave residual unreacted amounts of the two or more compounds or as to over fill the mold. The foaming mixture may expand to fill one or more empty spaces within the mold. The foaming mixture hardens or otherwise cures to the foamed polymer material when the reaction of the two compounds has progressed to substantial completion. The compounds may be mixed 606 prior to deposition in the mold, or may be mixed 606 in the mold. The reaction of the compounds progresses within the mold to expand the foaming mixture. In one embodiment, a first compound of the two or more compounds is a polyol and a second compound of the two or more compounds is an isocyanate. The polyol and isocyanate react to produce foamed polyurethane as the foamed polymer material.

As a foaming reaction of the compounds occurs, the foaming mixture expands to fill the mold. The mold is secured 608 in a closed position to contain expansion of the foaming mixture within the mold. The mold may be secured 608 in the closed position prior to deposition of the compounds. The mold may also be secured 608 in the closed position, such as by shutting and/or claiming a lid of the mold, while the two or more compounds react, and before the foaming mixture expands out of the mold. With the mold secured, the foaming reaction can progress to substantial completion and the resulting foaming mixture can dry, harden, or otherwise cure to a desired foamed polymer material.

After the foaming reaction of the two compounds has progressed to substantial completion and the foaming mixture has substantially hardened or cured to the foamed polymer material in a formed modular building, the modular building unit can be removed from the mold. Removing the modular building unit from the mold may include opening 610 the mold (e.g., opening a lid of the mold) and 612 injecting air within the mold beneath the foamed polymer material of the modular building unit. The injected air creates a pocket of air beneath the modular building unit. The air pressure within the pocket of can gradually rise to gradually raise the modular building unit at least partially out of the mold for removing the modular building unit from the mold.

The method 600 may also include configuring the mold, such as by adding or removing inserts such as column cores or beam cores.

Figure 7A:
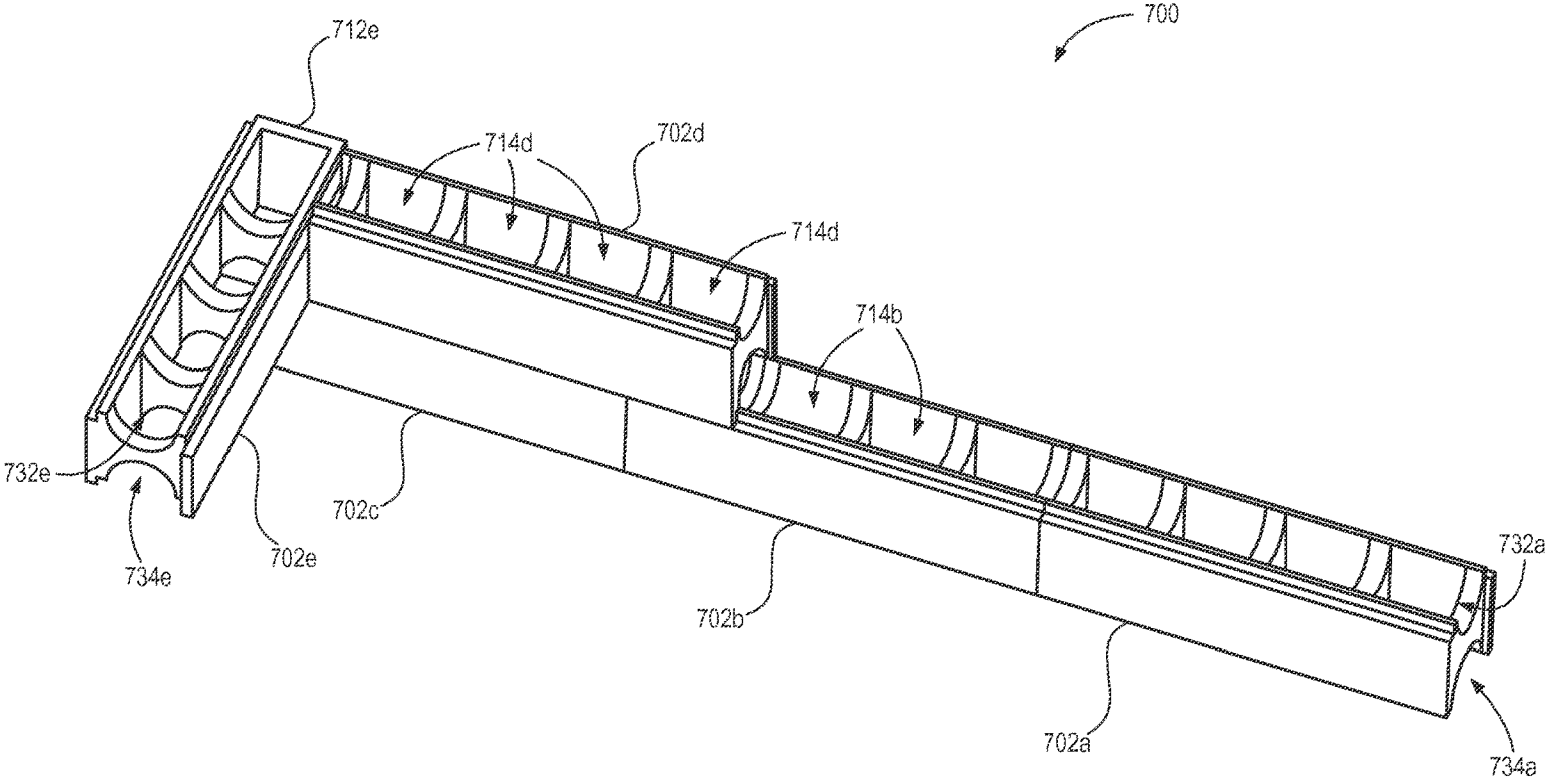
FIG. 7A is a perspective view of multiple modular building units, according to an embodiment of the present disclosure, assembled to erect an insulating concrete form for constructing a concrete wall.
Figure 7B:
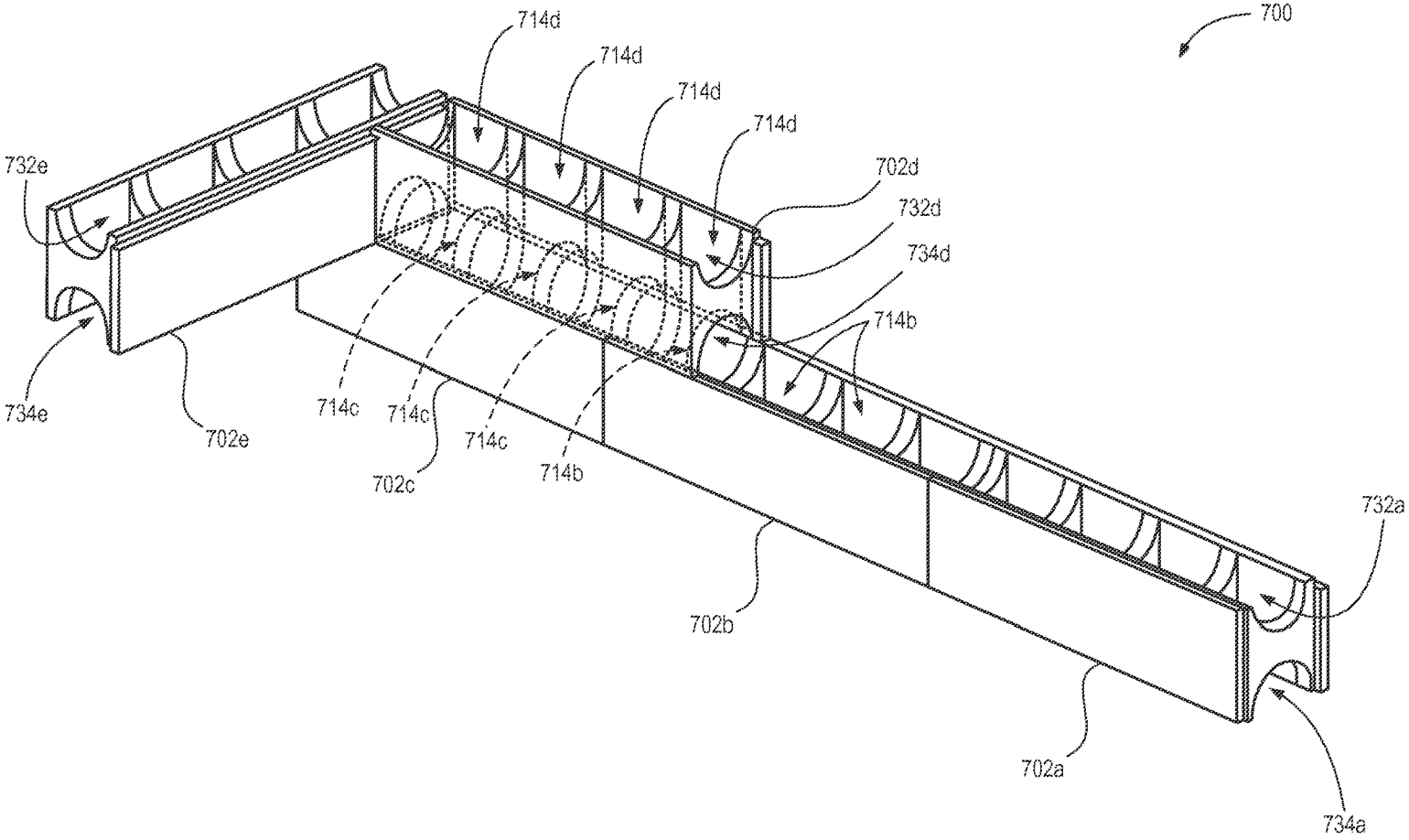
FIG. 7B is partial phantom perspective view of the insulating concrete form of FIG. 6A.
Figure 7C:
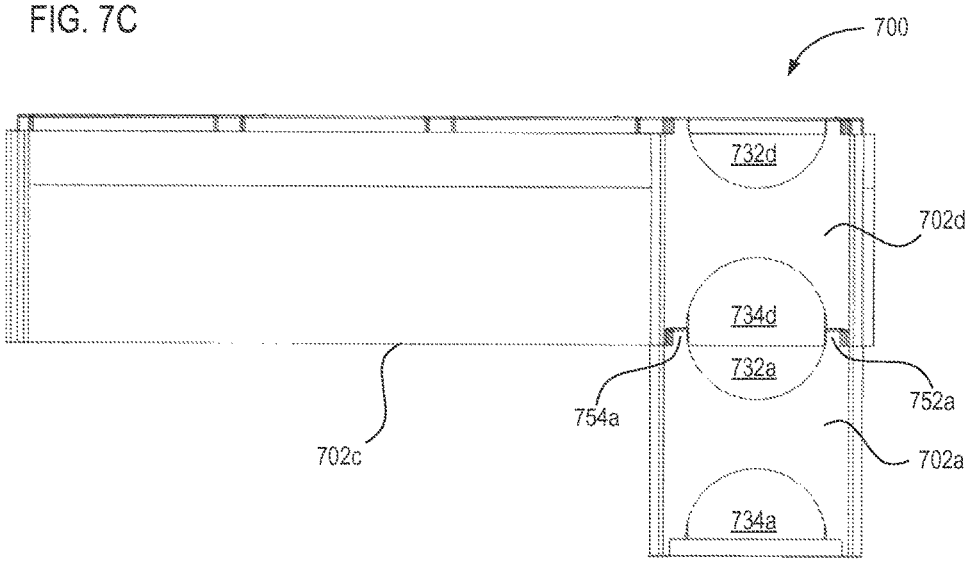
FIG. 7C is a right elevation view of the insulating concrete form of FIG. 6A.
Figure 7D:
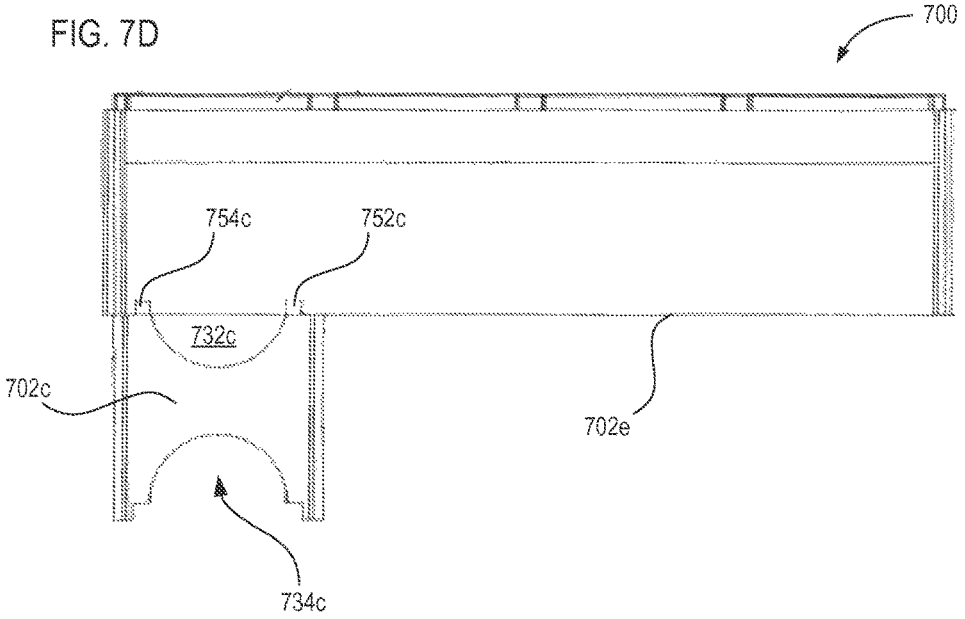
FIG. 7D is a left elevation view of the insulating concrete form of FIG. 6A.

FIGS. 7A-7D are various views of an insulating concrete form (ICF) 700 that is being erected using a plurality of modular building units 702*a*, 702*b*, 702*c*, 702*d*, 702*e* (generally and collectively 702), according to the present disclosure. The ICF 700 can be used to form concrete poured therein to construct a structure. FIG. 7A is a perspective view of the plurality of modular building units 702 stacked to erect the ICF 700 for constructing a concrete wall. FIG. 7B is a partial phantom perspective view of the ICF 700. FIG. 7C is a right elevation view of the ICF 700. FIG. 7D is a left elevation view of the ICF 700.

In the ICF 700 of FIGS. 7A-7D, the modular building units 702 or blocks 702 are stacked in a staggered arrangement, such that the block 702*d* on the second level overlaps both block 702*c* and block 702*b*. Nevertheless, the vertical column cavities 714*d* are each aligned with a vertical column cavity of block 702*c* or a vertical column cavity of block 702*b*. FIG. 7B, in particular, illustrates alignment of vertical column cavities 714*d* with vertical column cavities 714*c*, 714*b*.

FIGS. 7A-7D also show aligned upper horizontal beam cavities 732*a*, 732*b*, 732*c*, 732*d*, 732*e* (collectively 732) and aligned lower horizontal beam cavities 734*a*, 734*b*, 734*c*, 734*d*, 734*e* (collectively 734). The blocks 702 are configured to interconnect end to end to align one or more of the upper horizontal beam cavities 732 and lower horizontal beam cavities 734.

FIGS. 7C and 7D illustrate interconnection of stacked modular building units 702. The stacked modular units 702 may interconnect with tongue and groove joints. The tongues 752*a*, 752*c* are shown protruding into and interlocking with corresponding grooves in modular blocks stacked on top.

An end block 702*e* includes a full end support column 712*e* that does not include an inward offset to maintain concrete poured into the ICF 700 within the ICF 700. The end block 702*e* illustrates how a corner may be assembled using modular building units 702, according to the present disclosure.

FIGS. 7A-7D provide illustration of a basic stacking and interlocking configuration of a plurality of modular building units 702 to erect an ICF for pouring a concrete wall structure. As can be appreciated, other configurations are possible to erect ICFs for constructing other concrete structures. FIGS. 8-18 provide additional examples of ways that modular building units, according the present disclosure, may be used to construct structures.

Figure 8:
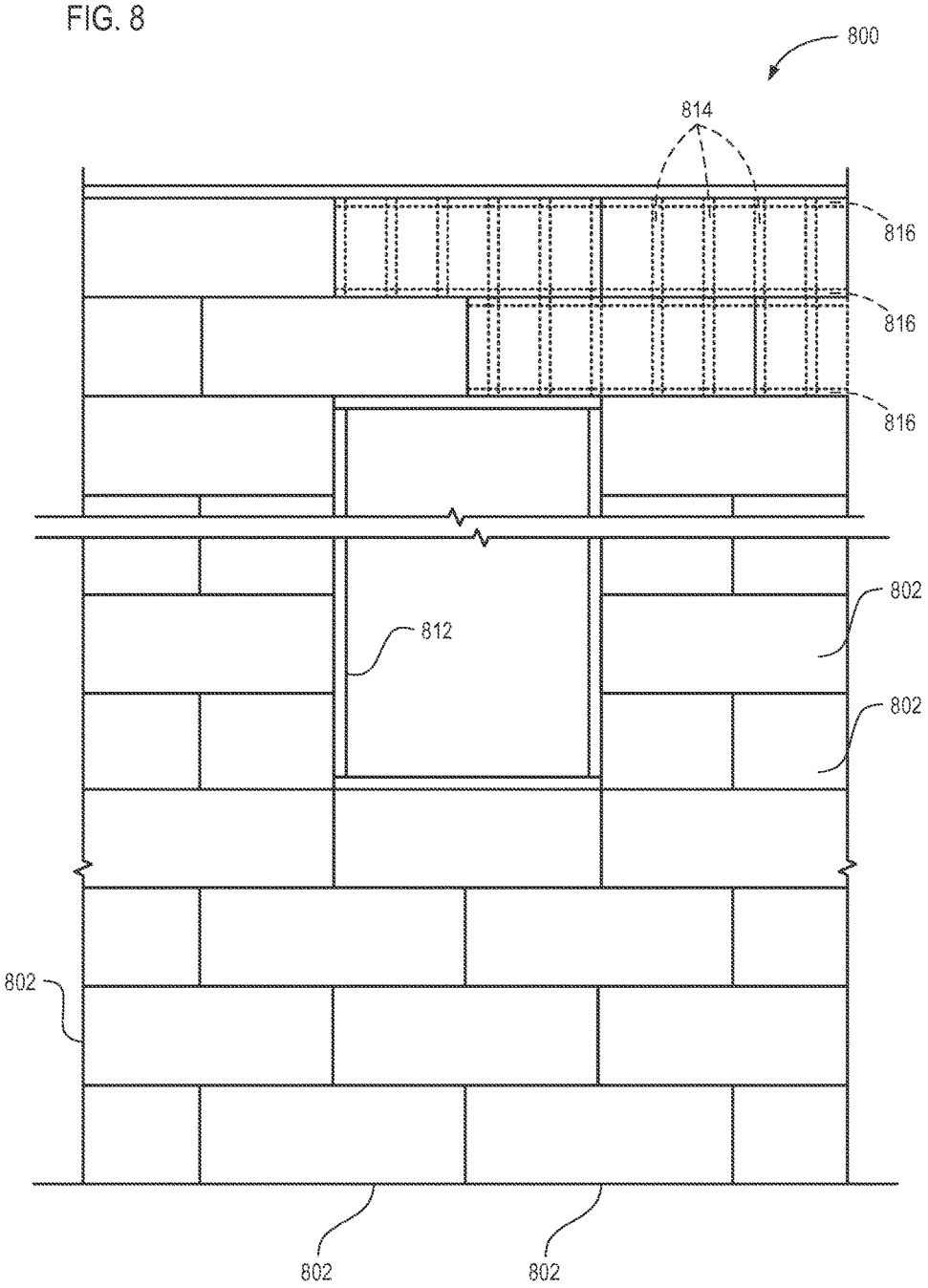
FIG. 8 is a front elevation view of a concrete structure constructed using modular building units, according to the present disclosure, including a typical window buck.

FIG. 8 is a front elevation view of a concrete structure 800 constructed using modular building units 802, according to the present disclosure, including a typical window buck 812. The concrete structure 800 is a combination of an ICF formed of the modular building units 802, any reinforcement material inserted into the cavities of the modular building units 802, concrete poured into the ICF, and the window buck 812. The modular building units 802 are stacked in a staggered configuration with each stacked modular unit 802 on top of two lower modular units 802. Concrete columns 814 formed by the ICF are shown in phantom. Beams 816 intersecting the concrete columns 814 are also shown in phantom. Different types of window bucks (wood, vinyl, or steel) may be used to create openings within the concrete structure 800.

Figure 9:
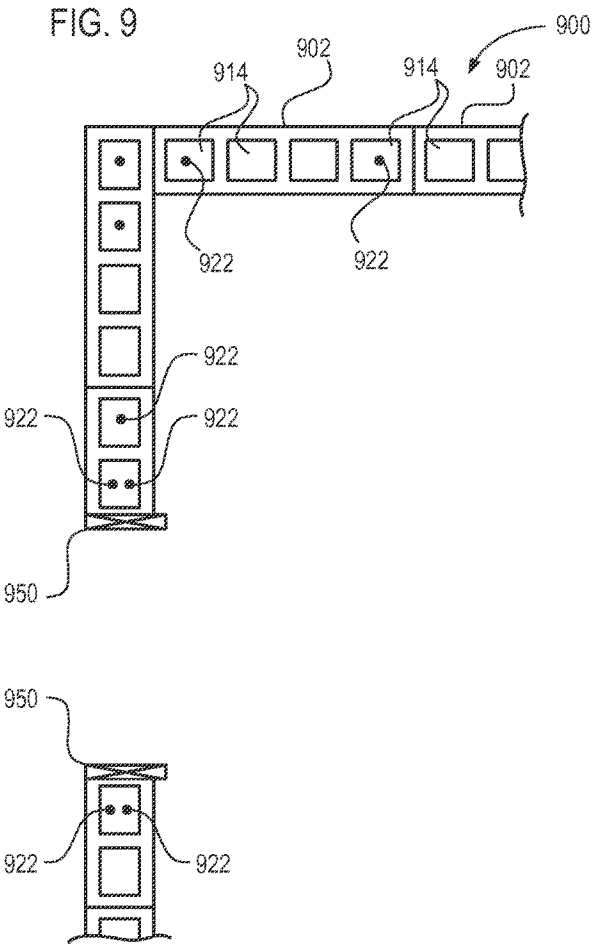
FIG. 9 is a top elevation view of a concrete structure constructed using modular building units, according to the present disclosure, with placement of steel rebar within columns.

FIG. 9 is a top elevation view of a concrete structure 900 constructed using modular building units 902, according to the present disclosure, with placement of steel rebar 922 within concrete columns 914. As can be appreciated, requirements for concrete reinforcement may vary for below-grade structure as compared to above-grade structure. For example, when installing an ICF below grade, it may be desirable to put a minimum of one number four rebar 922 in every column 914. By contrast, when installing an ICF above grade, it may be desirable to put a minimum of one number four rebar 922 every two feet or 24" on center. The rebar 922 reinforcement may be positioned in a variety of configurations within the vertical column cavities of the modular blocks 902 to reinforce the concrete columns 914. Additionally, when placing a window or door 950 in the structure 900 the placement of rebar 922 may be increased. For example, when including a door buck 950 or window buck in the structure, it may be desirable to place a minimum of two number four rebar in each of the columns adjacent to the window buck or door buck 950 as shown.

Figure 10:
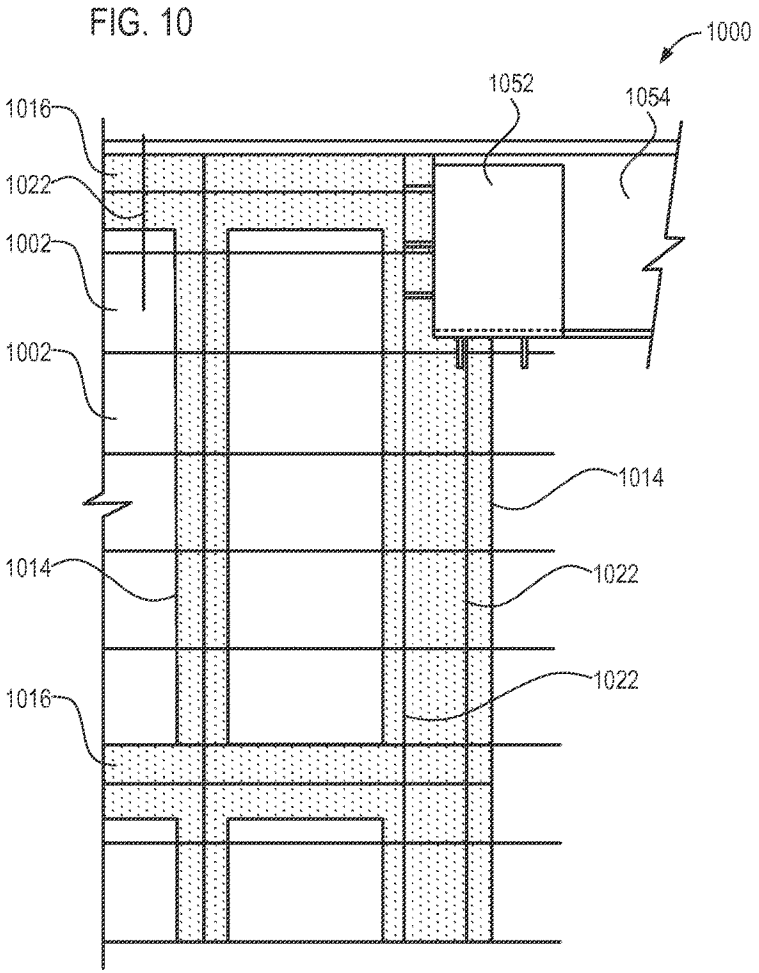
FIG. 10 is a sectional view of a concrete structure constructed using modular building units, according to the present disclosure, including a wood or metal beam pocket tied into the structure.

FIG. 10 is a sectional view of a concrete structure 1000 constructed using modular building units 1002, according to the present disclosure, including a wood or metal beam pocket 1052 tied into the structure 1000. The steel beam pocket 1052 is tied into a concrete column 1014 reinforced with steel rebar 1022. The steel beam pocket 1052 allows a wood or steel beam 1054 to attach to the wall system. The steel beam pocket 1052 of FIG. 10 has ¼" sides and a ¾" base, which are welded to the beam pocket 1052 embedded into the structure 1000.

Figure 11:
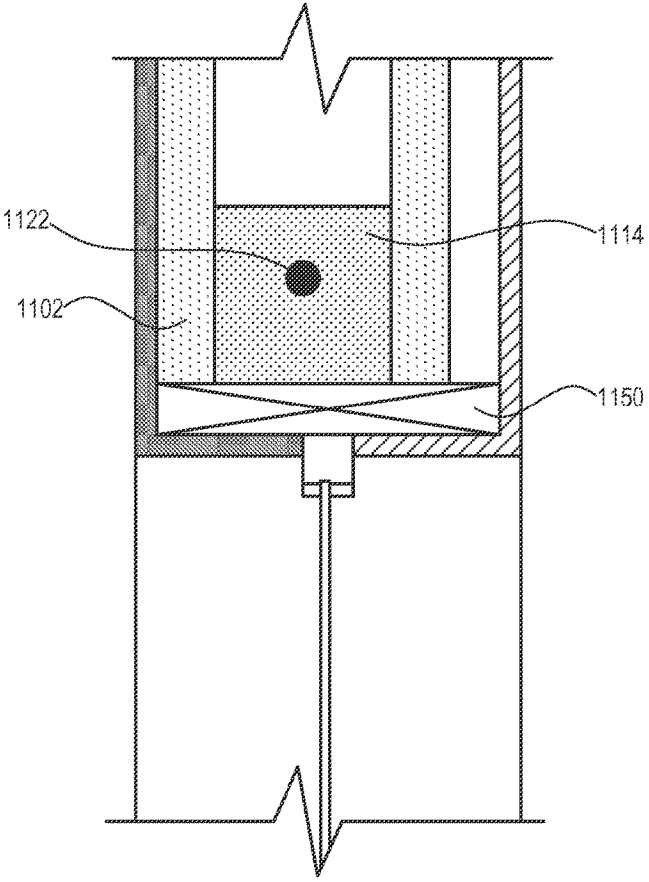
FIG. 11 is a sectional view of a concrete structure constructed using modular building units, according to the present disclosure, including steel rebar placement for windows and doors less than three feet wide.

FIG. 11 is a sectional view of a concrete structure 1100 constructed using modular building units 1102, according to the present disclosure, including steel rebar 1122 placement for windows and doors less than three feet wide. A single piece of rebar 1122 may be positioned in a column 1114 adjacent to the door or window. The placement of rebar 1122 creates the support necessary in the wall system to install a window or door buck 1150.

Figure 12:
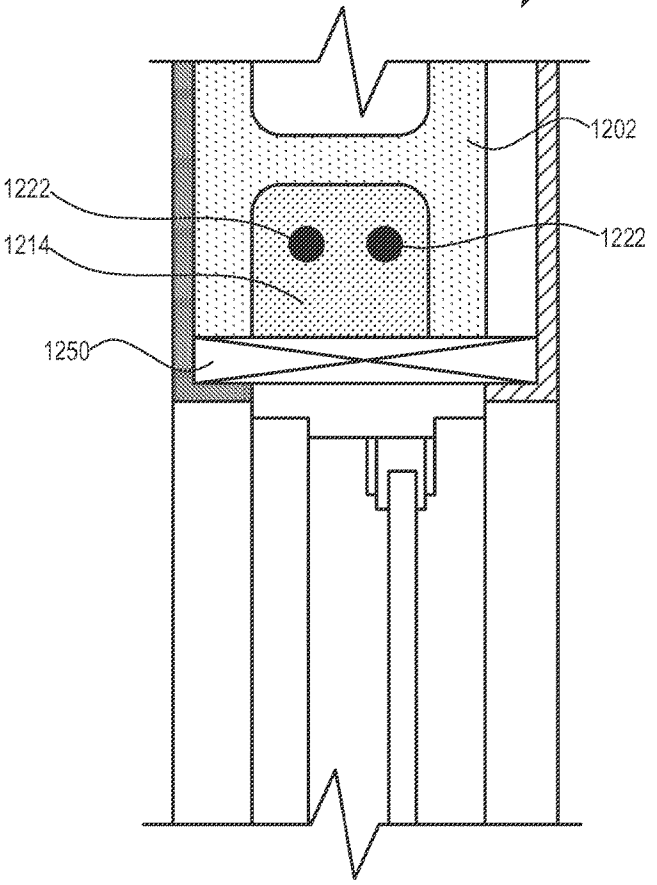
FIG. 12 is a sectional view of a concrete structure constructed using modular building units, according to the present disclosure, including steel rebar placement for windows and doors over three feet wide.

FIG. 12 is a sectional view of a concrete structure 1200 constructed using modular building units 1202, according to the present disclosure, including steel rebar 1222 placement for windows and doors over three feet wide. Multiple pieces of rebar 1222 may be positioned in a column 1214 adjacent to the door or window. The placement of rebar 1222 creates the support necessary in the wall system to install a window or door buck 1250.

Figure 13:
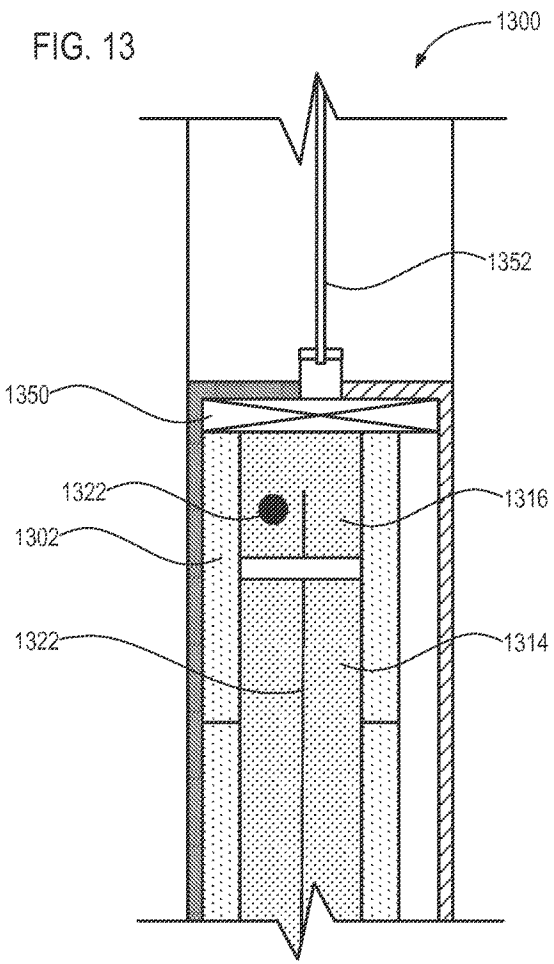
FIG. 13 is a sectional view of a concrete structure constructed using modular building units, according to the present disclosure, including steel rebar placement for window sills.

FIG. 13 is a sectional view of a concrete structure 1300 constructed using modular building units 1302, according to the present disclosure, including steel rebar 1322 placement for window sills. A piece of steel rebar 1322 may be positioned in a beam 1316 and a piece of steel rebar 1322 may also be positioned in an intersecting column 1314. A wood buck 1350 is positioned to support the window pane 1352. For example, a 2"×10" wood buck 1350 may be positioned under the window pane 1352. The placement of the rebar 1322 provide the column and bond beam strength to support the structure 1300 despite the cutout of the window.

Figure 14:
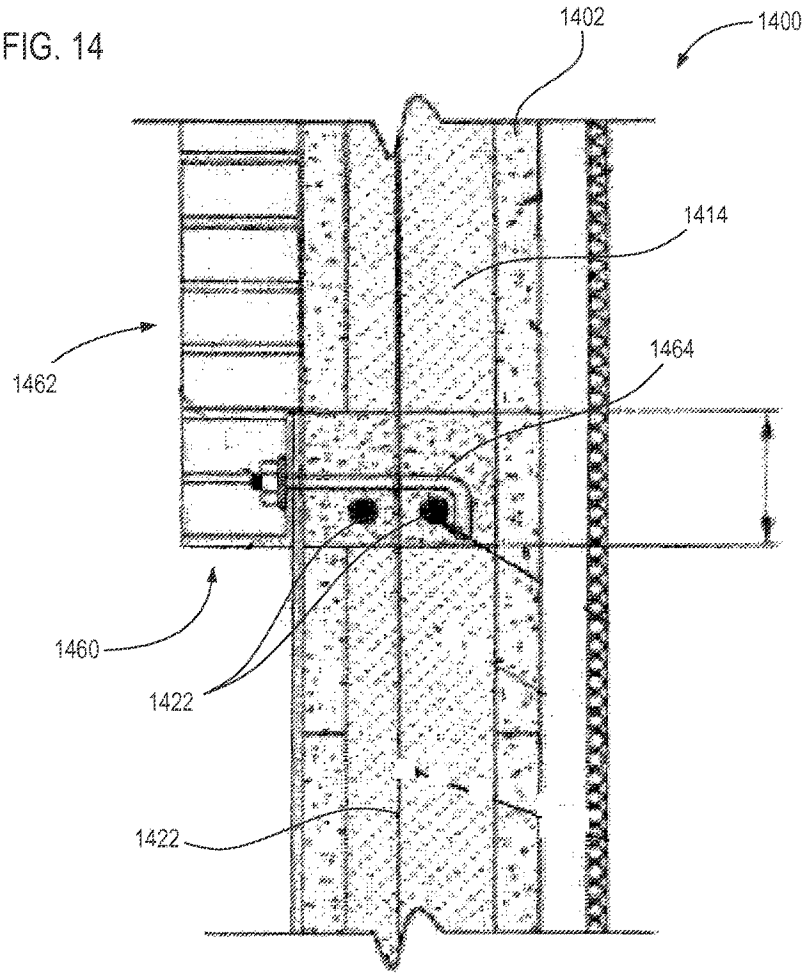
FIG. 14 is a sectional view of a concrete structure constructed using modular building units, according to the present disclosure, including a brick ledge installation.

FIG. 14 is a sectional view of a concrete structure 1400 constructed using modular building units 1402, according to the present disclosure, including a brick ledge 1460. The brick ledge 1460 is disposed on an exterior of the structure 1400 to support a brick façade 1462. Steel rebar 1422 is positioned both horizontally and vertically in the structure 1400. An angle iron 1464 may be embedded in a concrete column 1414 or beam 1416 to tie in the brick ledge 1460. The placement of the rebar 1422, horizontally to support the angle iron 1464 an vertically to reinforce the column 1414, provide the strength to support and attach the brick ledge 1460 to in turn support the brick façade 1462. The brick ledge 1460 can be made of many materials, but it is preferable for it to be made of galvanized steel.

Figure 15:
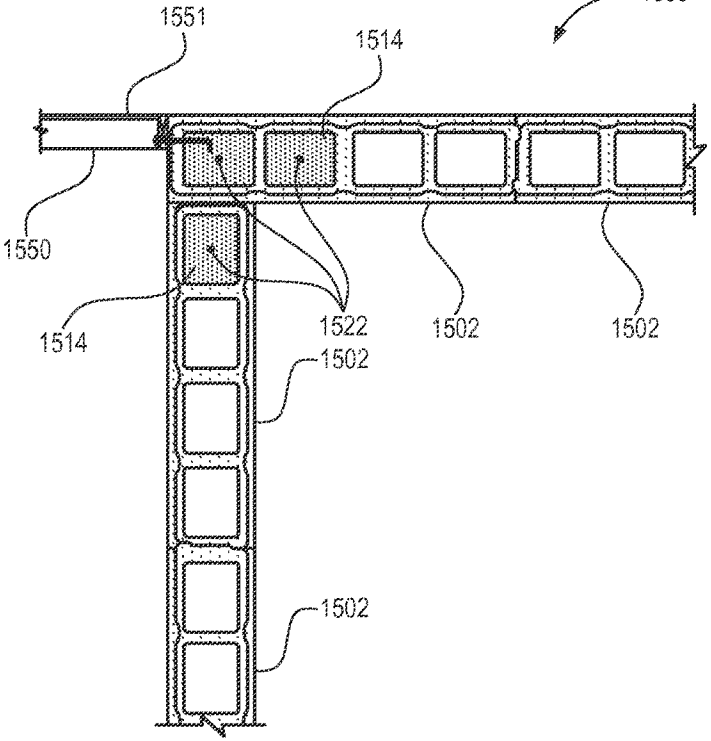
FIG. 15 is a sectional view of a concrete structure constructed using modular building units, according to the present disclosure, including exterior framing tied into the concrete structure.

FIG. 15 is a sectional view of a concrete structure 1500 constructed using modular building units 1502, according to the present disclosure, including exterior framing 1550 tied into the concrete structure 1500. A sheathing 1551 and a wood frame 1550 are shown in the figure. The placement of the rebar 1522 in concrete columns 1514 is also shown. The sheathing 1551 should be flush with the interlocking polyurethane block(s) 1502. Again, steel rebar 1522 may be positioned to ensure sufficient support from the structure 1500.

Figure 16:
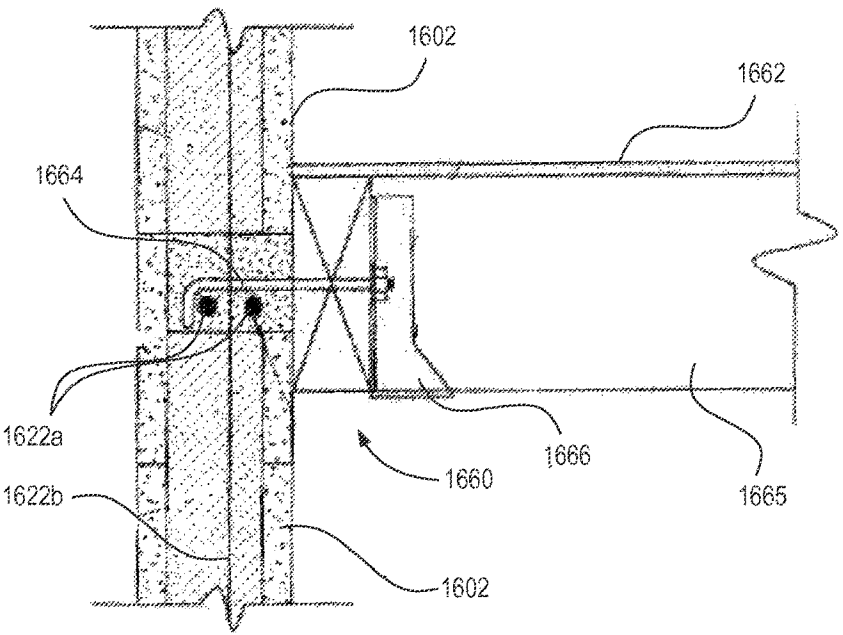
FIG. 16 is a sectional view of a concrete structure constructed using modular building units, according to the present disclosure, including a bearing ledger.

FIG. 16 is a sectional view of a concrete structure 1600 constructed using modular building units 1602, according to the present disclosure, including a bearing ledger 1660. The bearing ledger 1660 enables a floor decking 1662 to tie into the structure 1600. The floor decking 1662 is supported by a floor joist 1665 that is supported by a floor joist hanger 1666. Both horizontal rebar 1622*a* and vertical rebar 1622*b* are placed to reinforce the structure 1600. It is sometimes necessary to attach a floor 1600 to the wall of the structure 1600. The floor decking 1662 is disposed on top of the joist 1665, which is supported by the floor joist hanger 1666, to create proper support for the floor 1660. An angle iron 1664 is embedded in the concrete column 1614 or beam 1616 and supported by the horizontal rebar 1622*a* to adequately support the floor joist 1666, and the floor decking 1622.

Figure 17:
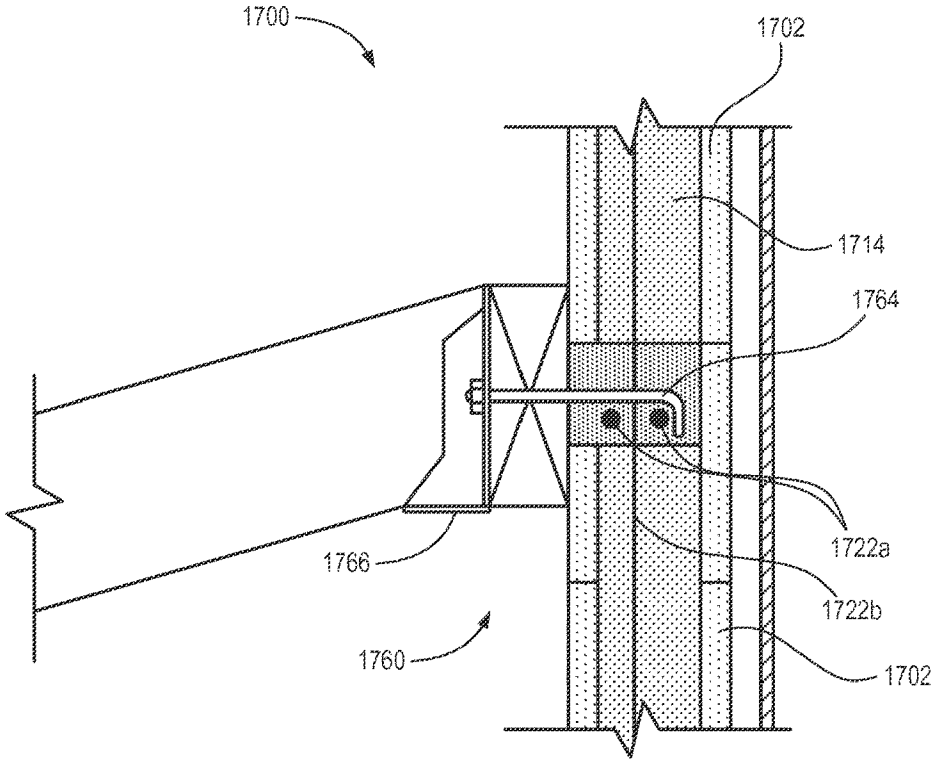
FIG. 17 is a sectional view of a concrete structure constructed using modular building units, according to the present disclosure, including an attachment of a rafter into the concrete structure.

FIG. 17 is a sectional view of a concrete structure 1700 constructed using modular building units 1702, according to the present disclosure, including an attachment of a rafter 1760 into the concrete structure 1700. The rafter 1760 is supported by a joist hanger 1766, which ties into the concrete column 1714 by an embedded angel iron 1764. Vertical rebar 1722*b* and horizontal rebar 1722*a* reinforce the structure 1700 and support the joist hanger 1766.

Figure 18:
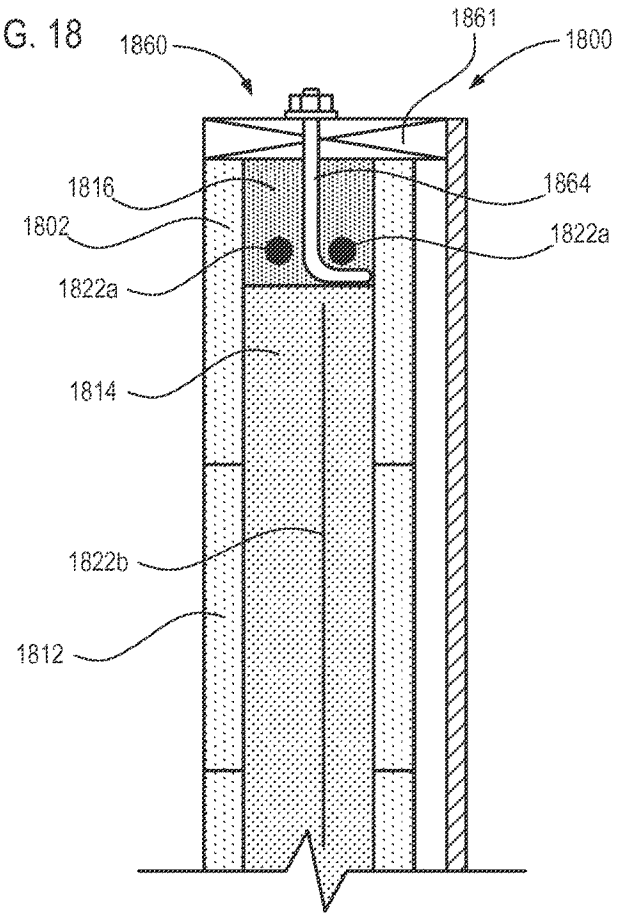
FIG. 18 is a sectional view of a concrete structure constructed using modular building units, according to the present disclosure, including an attachment of a rafter on to a top of the concrete structure.

FIG. 18 is a sectional view of a concrete structure 1800 constructed using modular building units 1802, according to the present disclosure, including an attachment of a rafter 1860 on to a top of the concrete structure 1800. An anchor bolt 1864 is embedded in concrete of a bond beam 1816. Horizontal rebar 1822*a* is included in the beam 1816 and vertical rebar 1822*b* is included in the column 1814. When attaching a top plate 1861 with an anchor bolt 1864 into the bond beam 1816, it may be advantageous to place multiple horizontal rebar 1822*a* in close proximity in the bond beam 1816 to provide adequate strength.

Figure 19:
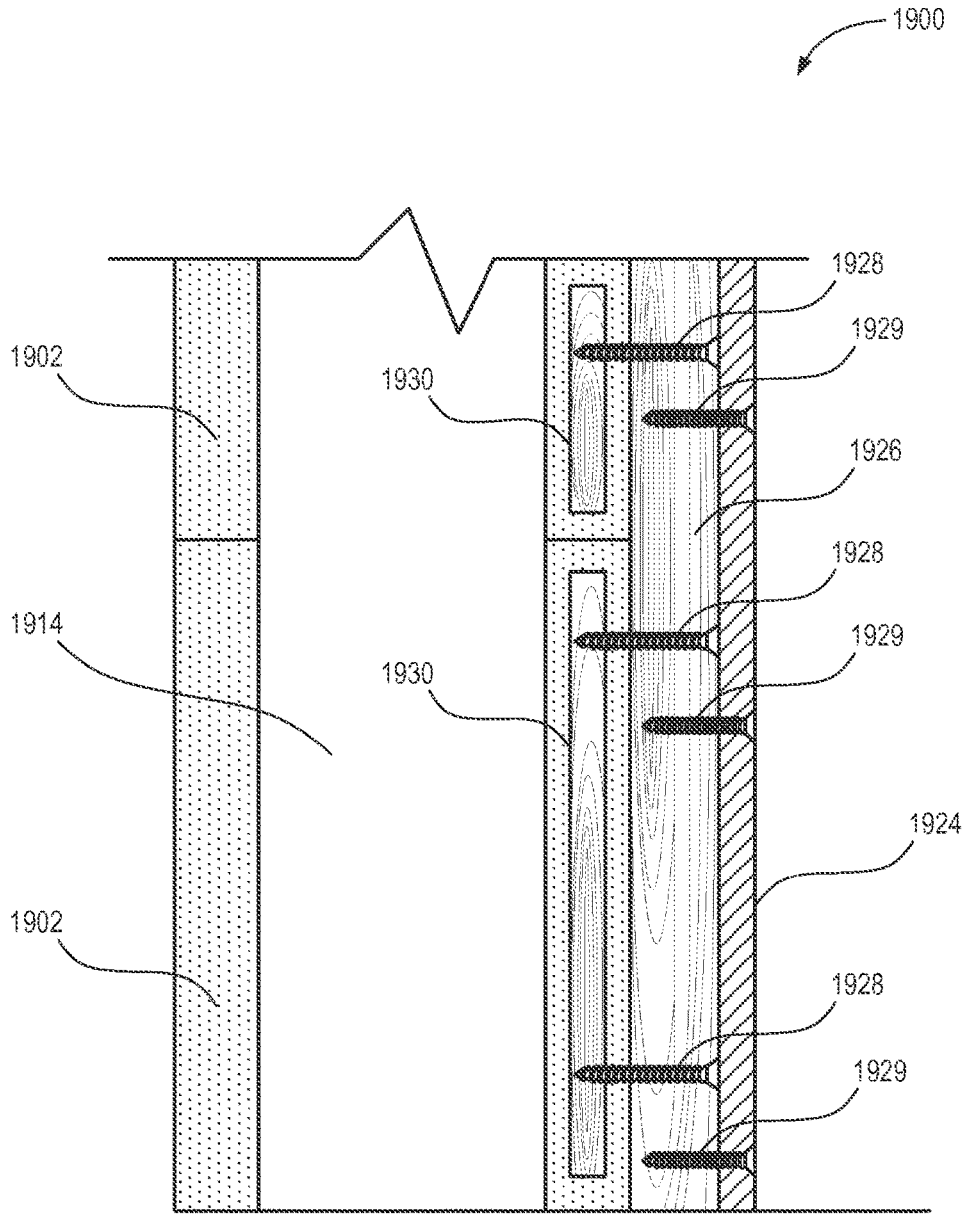
FIG. 19 is a sectional view of a bottom portion of a concrete structure constructed using modular building units, according to the present disclosure.

FIG. 19 is a sectional view of a bottom portion of a concrete structure 1900 constructed using modular building units 1902, according to the present disclosure. A plurality of polyurethane molding units 1902 are stacked to form an ICF and a concrete column 1914 (and bond beams, not shown) are running therethrough. A wood beam 1926 (or stud) is secured to the modular building units 1902 by screws 1928 that screw into wood strips 1930 embedded within the modular building units 1902. Sheetrock 1924 is then secured to the stud 1926 with screws 1929.

EXAMPLE EMBODIMENTS

Some examples of embodiments of modular building units, molds, and methods of manufacturing and using the same are provided below.

Example 1

A modular building unit for erecting insulated concrete forms for constructing structures, comprising: a front panel formed of a foamed polymer material, the front panel including an inner surface to provide a form for concrete when poured into the modular building unit; a back panel formed of the foamed polymer material, the back panel including an inner surface to provide a form for concrete when poured into the modular building unit; a plurality of support members formed of the foamed polymer material, the plurality of support members: extending between and coupling the front panel to the back panel; spaced from each other to at least partially define a vertical column cavity between the front panel and the back panel and extending within the modular building unit from a top opening at a top of the modular building unit to a bottom opening at a bottom of the modular building unit; and at least partially defining a horizontal beam cavity between the front panel and the back panel, the horizontal beam cavity extending along a length of the modular building unit to intersect with the vertical column cavity, wherein the modular building unit is configured to stack on top of a second modular building unit with the vertical column cavity aligned with a vertical column cavity of the second modular building unit to form a column of concrete, when poured into the modular building unit, that extends from a bottom opening of the vertical column cavity of the second modular building unit to the top opening of the vertical column cavity, and wherein the horizontal beam cavity at least partially forms a beam of concrete, when poured into the modular building unit, that extends along a length of the modular building unit and intersects with the column of concrete.

Example 2

The modular building unit of Example 1, wherein the horizontal beam cavity cooperates with a horizontal beam cavity of the second modular building unit to define the horizontal beam cavity and form the beam of concrete, when poured into the modular building unit, that extends along a length of the modular building unit and intersects with the column of concrete.

Example 3

The modular building unit of Example 1, wherein each support member of the plurality of support members includes a vertical depression that at least partially defines the horizontal beam cavity.

Example 4

The modular building unit of Example 3, wherein the vertical depression is a semi-circle shape.

Example 5

The modular building unit of Example 3, wherein the vertical depression of each support member is disposed in a top surface of the support member.

Example 6

The modular building unit of Example 3, wherein the vertical depression of each support member is disposed in a bottom surface of the support member.

Example 7

The modular building unit of Example 1, wherein each support member of the plurality of support members comprises: a first vertical depression disposed in a bottom surface of the support member that at least partially defines a lower horizontal beam cavity; and a second vertical depression disposed in a top surface of the support member that at least partially defines an upper horizontal beam cavity.

Example 8

The modular building unit of Example 1, wherein each support member of the plurality of support members includes a gap that at least partially defines the horizontal beam cavity.

Example 9

The modular building unit of Example 8, wherein the gap is a semi-circle shape.

Example 10

A mold for molding a foamed polymer material into a modular building unit to be used for erecting insulated concrete forms to construct a concrete structure, the mold comprising: a mold box including: a front side plate to form an outer surface of a front panel of the modular building unit; a back side plate to form an outer surface of a back panel of the modular building unit; a first end plate coupled to a first end of the front side plate and a first end of the back side plate, the first end plate to form a first end surface of the front panel and the back panel of the modular building unit and to form an outer surface of a first end support member that couples the front panel and the back panel; a second end plate coupled to a second end of the front side plate and a second end of the back side plate, the second end plate to form a second end surface of the front panel and the back panel of the modular building unit and to form an outer surface of a second end support member that couples the front panel and the back panel; a lid to form a top surface of the front panel and the back panel of the modular building unit; and a base to form a bottom surface of the front panel and the back panel of the modular building unit; a plurality of column cores to be positioned within the mold box to at least partially form a plurality of support members coupling the front panel and the back panel of the modular building unit, wherein the front panel, the back panel, and the plurality of support members define a plurality of vertical column cavities of the modular building unit, each column core of the plurality of column cores to at least partially form an inner surface of the front panel of the modular building unit and an inner surface of the back panel of the modular building unit, each column core to further define two of: an inner surface of the first end support member, an inner surface of the second end support member, and a vertical surface of an inner support member; and a first plurality of beam cores coupled to one of the lid and the base to be positioned within the mold box to at least partially form a horizontal beam cavity of the modular building unit, wherein each beam core of the first plurality of beam cores forms one of a top surface and a bottom surface of a support member, wherein each beam core of the first plurality of beam cores is configured to engage a column core to form the horizontal beam cavity to intersect a vertical column cavity of the plurality of vertical column cavities.

Example 11

The mold of Example 10, further comprising: a second plurality of beam cores coupled to the other one of the lid and the base to be positioned within the mold box to at least partially define a second horizontal beam cavity of the modular building unit, wherein each beam core of the second plurality of beam cores forms the other one of the top surface and the bottom surface of a support member, wherein each beam core of the second plurality of beam cores is configured to engage a column core to form the second horizontal beam cavity to intersect a vertical column cavity of the plurality of vertical column cavities.

Example 12

The mold of Example 10, wherein each beam core of the plurality of beam cores forms a semicircle-shaped gap in the one of the top surface and the bottom surface of the support member.

Example 13

A method of manufacturing a modular building unit for erecting insulated concrete forms for constructing structures, comprising: applying an anti-bonding agent to a mold for molding a foamed polymer material into a modular building unit configured to stack with other modular building units and to provide a form for concrete when poured into the modular building unit, the mold configured to mold the modular building unit to define a vertical column cavity and to at least partially define a horizontal beam cavity intersecting the vertical column cavity; mixing two or more compounds that react to produce a foaming mixture that expands within the mold to fill one or more empty spaces within the mold, wherein the foaming mixture hardens or cures to the foamed polymer material when the reaction of the two compounds has progressed to substantial completion; securing the mold in a closed position while the two or more compounds react to contain expansion of the foaming mixture within the mold; and removing the modular building unit from the mold after the reaction of the two compounds has progressed to substantial completion and the foaming mixture has substantially hardened or cured to the foamed polymer material.

Example 14

The method of Example 13, wherein removing the modular building unit from the mold comprises: opening a lid of the mold after the reaction of the two compounds has progressed to substantial completion and the foaming mixture has substantially hardened or cured to the foamed polymer material; and injecting air within the mold beneath the foamed polymer material of the modular building unit to raise the modular building unit at least partially out of the mold for removing the modular building unit from the mold.

Example 15

The method of Example 13, wherein a first compound of the two or more compounds is a polyol and a second compound of the two or more compounds is an isocyanate, and wherein the first compound and the second compound react to produce foamed polyurethane as the foamed polymer material.

Example 16

The method of Example 13, wherein applying an anti-bonding agent to the mold comprises lining the mold with on more sheets of polytetrafluoroethylene.

Example 17

The method of Example 13, wherein applying an anti-bonding agent to the mold comprises applying a silicone-based liquid.

Example 18

The method of Example 13, further comprising inserting wood strips into the mold in a position to be embedded within at least one of the front panel and the back panel of the modular building unit, wherein the wood strips are configured to receive and retain screws inserted into the modular building unit for providing finishing to a structure constructed with the modular building unit.

Example 19

The method of Example 13, wherein the mold comprises the mold of Example 10.

Example 20

The method of Example 13, wherein the mold is configured to form a modular block of Example 1.

Example 21

A method of constructing a concrete structure, comprising: stacking a plurality of modular building units to erect an insulated concrete form, the modular building units formed of a foamed polymer material, the modular building units configured to receive concrete in a liquid state and to form the concrete into a plurality of discrete columns extending vertically through the plurality of modular building units, the modular building units being further configured to form the concrete into a plurality of discrete beams each extending horizontally and intersecting each column of the plurality of columns; pouring concrete in a liquid state into the plurality of modular building units; and allowing the concrete to cure into a concrete structure.

Example 22

The method of Example 21, further comprising: positioning rebar within a vertical column cavity formed by stacking the plurality of modular building units, the rebar to reinforce a discrete column of concrete extending vertically through the plurality of modular building units.

Example 23

The method of Example 21, further comprising: positioning rebar within a horizontal beam cavity formed by stacking the plurality of modular building units, the rebar to reinforce a discrete beam of concrete extending horizontally and intersecting each column of the plurality of columns.

As will be obvious to those having skill in the art, many changes may be made to the details of the above-described embodiments without departing from the underlying principles of the invention. The scope of the present invention should, therefore, be determined only by the following claims.

The invention claimed is:

1. A mold for molding a foamed polymer material into a modular building unit to be used for erecting insulated concrete forms to construct a concrete structure, the mold comprising:

a mold box including:

a front side plate to form an outer surface of a front panel of the modular building unit;

a back side plate to form an outer surface of a back panel of the modular building unit;

a first end plate coupled to a first end of the front side plate and a first end of the back side plate, the first end plate to form a first end surface of the front panel and the back panel of the modular building unit and to form an outer surface of a first end support member that couples the front panel and the back panel;

a second end plate coupled to a second end of the front side plate and a second end of the back side plate, the second end plate to form a second end surface of the front panel and the back panel of the modular building unit and to form an outer surface of a second end support member that couples the front panel and the back panel;

a lid to form a top surface of the front panel and the back panel of the modular building unit; and a base to form a bottom surface of the front panel and the back panel of the modular building unit;

a plurality of column cores to be positioned within the mold box to at least partially form a plurality of support members coupling the front panel and the back panel of the modular building unit, wherein the front panel, the back panel, and the plurality of support members define a plurality of vertical column cavities of the modular building unit, each column core of the plurality of column cores to at least partially form an inner surface of the front panel of the modular building unit and an inner surface of the back panel of the modular building unit, each column core to further define two of: an inner surface of the first end support member, an inner surface of the second end support member, and a vertical surface of an inner support member; and a first plurality of beam cores coupled to one of the lid and the base to be positioned within the mold box to at least partially form a horizontal beam cavity of the modular building unit, wherein each beam core of the first plurality of beam cores forms one of a top surface and a bottom surface of a support member, wherein each beam core of the first plurality of beam cores is configured to engage a column core of the plurality of column cores to form the horizontal beam cavity to intersect a vertical column cavity of the plurality of vertical column cavities.

2. The mold of claim 1, wherein the front side plate comprises an inner surface including a taper to form a corresponding taper in an outer surface of the front panel between an upper portion and a lower portion of the outer surface.

3. The mold of claim 2, wherein the inner surface of the front side plate forms an upper portion of the outer surface of the front panel to be displaced away from a longitudinal centerline of the modular building unit further than a lower portion of the outer surface of the front panel.

4. The mold of claim 1, further comprising a taper disposed in an inner surface of one or more of the front side plate, the back side plate, the first end plate, and the second end plate, the taper of the mold to form a taper in the modular building unit such that an upper portion of an outer surface of each of one or more of the front panel, the back panel, the first end support member, and the second end support member is displaced away from a longitudinal centerline of the modular building unit further than a lower portion of the outer surface of each of the one or more of the front panel, the back panel, the first end support member, and the second end support member.

5. The mold of claim 1, wherein the mold forms the modular building unit with a taper on an outer wall, an inner wall within a vertical column cavity of the plurality of column cavities, or both an outer wall and an inner wall of the modular building unit.

6. The mold of claim 1, further comprising a compressed air system configured to inject air into the mold box beneath a formed modular building unit to raise the modular building unit at least partially out of the mold.

7. The mold of claim 1, further comprising: a second plurality of beam cores coupled to the other one of the lid and the base to be positioned within the mold box to at least partially define a second horizontal beam cavity of the modular building unit, wherein each beam core of the second plurality of beam cores forms the other one of the top surface and the bottom surface of a support member, wherein each beam core of the second plurality of beam cores is configured to engage a column core of the plurality of column cores to form the second horizontal beam cavity to intersect a vertical column cavity of the plurality of vertical column cavities.

8. The mold of claim 1, wherein each beam core of the plurality of beam cores forms a semicircle-shaped gap in the one of the top surface and the bottom surface of the support member.

9. The mold of claim 1, wherein the lid pivots between a closed position and an open position about hinges coupled to the back side plate.

10. The mold of claim 1, wherein the lid clamps into a closed position to form an airtight seal on the mold box.

11. A mold for forming a foamed polymer material into an insulated concrete form to construct a concrete structure, the mold comprising:

a mold box having a plurality of sides, a base, and a lid forming an airtight chamber to receive the foamed polymer material;

a plurality of column cores to be positioned within the mold box to at least partially form a plurality of support members coupling a front panel and a back panel of the insulated concrete form, wherein the mold box and the plurality of column cores are to form the front panel, the back panel, and the plurality of support members to define a plurality of vertical column cavities within the insulated concrete form, and wherein the base of the mold box forms a bottom surface of the front panel and the back panel of the insulated concrete form; and the lid of the mold box forms a top surface of the front panel and the back panel of the insulated concrete from;

a first plurality of beam cores coupled to one of the lid of the mold box and the base of the mold box, the first plurality of beam cores to be positioned within the mold box to at least partially form a horizontal beam cavity of the insulated concrete form, wherein each beam core of the first plurality of beam cores is configured to engage a column core of the plurality of column cores to form the horizontal beam cavity to intersect a vertical column cavity of the plurality of vertical column cavities.

12. The mold of claim 11, further comprising a taper disposed in an inner surface of a sidewall of the mold box to form a taper in the insulated concrete form such that an upper portion of an outer surface of one or more of the front panel, the back panel, a first end, and a second end of the insulated concrete form is displaced away from a longitudinal centerline of the insulated concrete form further than a lower portion of the outer surface of the one or more of the front panel, the back panel, the first end, and the second end of the insulated concrete form.

13. The mold of claim 12, wherein the taper disposed in the inner surface of the sidewall forms a lower portion of the insulated concrete form to have a thickness that is smaller than a thickness of an upper portion of the insulated concrete form.

14. The mold of claim 11, wherein the mold forms the insulated concrete form with a taper on one or more of an outer wall and an inner wall within a vertical column cavity of the plurality of vertical column cavities.

15. The mold of claim 11, further comprising a compressed air system configured to inject air into the mold box beneath a formed insulated concrete form to raise the insulated concrete form at least partially out of the mold.

16. The mold of claim 11, further comprising: a second plurality of beam cores coupled to the other one of the lid and the base, the second plurality of beam cores to be positioned within the mold box to at least partially define a second horizontal beam cavity of the insulated concrete form, wherein each beam core of the second plurality of beam cores is configured to engage a column core of the plurality of column cores to form the second horizontal beam cavity to intersect a vertical column cavity of the plurality of vertical column cavities.

17. The mold of claim 11, wherein each beam core of the plurality of beam cores forms a semicircle-shaped gap in one of a top surface and a bottom surface of a support member of the plurality of support members.

18. The mold of claim 11, comprising a lid that clamps on top of the mold box to seal the mold box in an airtight configuration.

19. The mold of claim 11, wherein the mold box forms the insulated concrete form to couple to other insulated concrete forms in a tongue and groove fashion and to form vertical concrete columns and horizontal concrete beams.

20. A mold for forming a foamed polymer material into a modular building unit to couple to other modular building units to erect an insulated concrete form system to construct a concrete structure, the mold comprising:

a mold box forming an airtight chamber to receive the foamed polymer material;

a plurality of column cores to be positioned within the mold box to at least partially form a plurality of support members coupling a front panel and a back panel of the modular building unit, wherein the mold box and the plurality of column cores are to form the front panel, the back panel, and the plurality of support members to define a plurality of vertical column cavities within the modular building unit;

a first plurality of beam cores coupled to one of a top of the mold box and a base of the mold box, the first plurality of beam cores to be positioned within the mold box to at least partially form a horizontal beam cavity of the modular building unit, wherein each beam core of the first plurality of beam cores is configured to engage a column core of the plurality of column cores to form the horizontal beam cavity to intersect a vertical column cavity of the plurality of vertical column cavities;

a taper disposed in an inner surface of a sidewall of the mold box to form a taper in the modular building unit such that an upper portion of an outer surface of one or more of the front panel, the back panel, a first end, and a second end of the modular building unit is displaced away from a longitudinal centerline of the modular building unit further than a lower portion of the outer surface of the one or more of the front panel, the back panel, the first end, and the second end of the modular building unit; and an air injection system configured to inject air into the mold box beneath a formed modular building unit to raise a bottom edge of the modular building unit at least partially out of the mold to the taper disposed in the inner surface of the sidewall of the mold box.

* * * * *